US011841652B2

(12) United States Patent
Saitoh et al.

(10) Patent No.: US 11,841,652 B2
(45) Date of Patent: Dec. 12, 2023

(54) CONTACT-SEPARATION DEVICE, FIXING DEVICE, AND IMAGE FORMING APPARATUS

(71) Applicants: Seiji Saitoh, Kanagawa (JP); Takahiro Imada, Kanagawa (JP); Yoshikuni Sasaki, Kanagawa (JP); Tamotsu Ikeda, Tokyo (JP); Hiromasa Takagi, Tokyo (JP); Jun Okamoto, Tokyo (JP)

(72) Inventors: Seiji Saitoh, Kanagawa (JP); Takahiro Imada, Kanagawa (JP); Yoshikuni Sasaki, Kanagawa (JP); Tamotsu Ikeda, Tokyo (JP); Hiromasa Takagi, Tokyo (JP); Jun Okamoto, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/825,471

(22) Filed: May 26, 2022

(65) Prior Publication Data

US 2023/0004107 A1 Jan. 5, 2023

(30) Foreign Application Priority Data

Jul. 5, 2021 (JP) ..... 2021-111719

(51) Int. Cl.
*G03G 15/20* (2006.01)

(52) U.S. Cl.
CPC ..... *G03G 15/2032* (2013.01); *G03G 15/2064* (2013.01); *G03G 2215/2009* (2013.01)

(58) Field of Classification Search
CPC ..... G03G 15/2032; G03G 15/2064
See application file for complete search history.

(56) References Cited

U.S. PATENT DOCUMENTS 5,300,996 A 4/1994 Yokoyama et al.
5,648,842 A 7/1997 Sekine et al.
(Continued)

FOREIGN PATENT DOCUMENTS

JP 2007-025349 2/2007
JP 2015-009944 1/2015
(Continued)

OTHER PUBLICATIONS

U.S. Appl. No. 17/574,578, filed Jan. 13, 2022, Shigeo Nanno, et al.

*Primary Examiner* — Arlene Heredia
(74) *Attorney, Agent, or Firm* — Harness, Dickey & Pierce, P.L.C.

(57) ABSTRACT

A contact-separation device brings a contact-separation member into contact with a contacted member separably and includes a biasing member that generates a biasing force. A presser presses the contact-separation member against the contacted member in a pressing direction with the biasing force from the biasing member. A cam presses the presser in an opposite direction being opposite to the pressing direction. The cam is rotatable and has a cam face. A cam follower has a cam contact face that contacts the cam face of the cam. The cam contact face is curved to project toward the cam. The cam contact face has a curvature that is smaller than a greatest curvature of the cam face of the cam and is greater than a smallest curvature of the cam face of the cam.

19 Claims, 12 Drawing Sheets

(56) References Cited

U.S. PATENT DOCUMENTS

| | | | | |
|---|---|---|---|---|
| 5,678,153 | A | 10/1997 | Okamoto et al. | |
| 5,679,462 | A | 10/1997 | Soga et al. | |
| 5,873,017 | A | 2/1999 | Soga et al. | |
| RE36,124 | E | 3/1999 | Yokoyama et al. | |
| 5,913,092 | A | 6/1999 | Bisaiji et al. | |
| 6,067,435 | A | 5/2000 | Soga et al. | |
| 6,104,889 | A | 8/2000 | Saitoh | |
| 6,125,257 | A | 9/2000 | Sekine et al. | |
| 7,274,897 | B2 * | 9/2007 | Katoh | G03G 21/1619 399/121 |
| 8,014,701 | B2 * | 9/2011 | Nakura | G03G 15/162 399/297 |
| 8,422,037 | B2 * | 4/2013 | Hodoshima | G03G 15/161 399/407 |
| 10,054,885 | B2 * | 8/2018 | Okamoto | G03G 15/206 |
| 10,852,671 | B2 * | 12/2020 | Imada | G03G 15/2025 |
| 2003/0007817 | A1 | 1/2003 | Saitoh | |
| 2004/0179875 | A1 | 9/2004 | Iwata et al. | |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0139584 | A1 | 6/2005 | Kishi et al. | |
| 2005/0175368 | A1 | 8/2005 | Matsusaka et al. | |
| 2005/0175370 | A1 | 8/2005 | Matsusaka et al. | |
| 2006/0039713 | A1 | 2/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2007/0036573 | A1 | 2/2007 | Kishi et al. | |
| 2008/0080912 | A1 | 4/2008 | Sawahata et al. | |
| 2008/0145088 | A1 | 6/2008 | Matsusaka et al. | |
| 2009/0274477 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2009/0317113 | A1 | 12/2009 | Kishi et al. | |
| 2010/0189478 | A1 * | 7/2010 | Takahashi | G03G 15/2032 399/331 |
| 2011/0026988 | A1 | 2/2011 | Yoshikawa et al. | |
| 2011/0044734 | A1 | 2/2011 | Shimokawa et al. | |
| 2011/0058862 | A1 | 3/2011 | Yamaguchi et al. | |
| 2011/0064440 | A1 | 3/2011 | Saitoh | |
| 2011/0064443 | A1 | 3/2011 | Iwaya et al. | |
| 2011/0064490 | A1 | 3/2011 | Imada et al. | |
| 2011/0064502 | A1 | 3/2011 | Hase et al. | |
| 2011/0129268 | A1 | 6/2011 | Ishii et al. | |
| 2011/0150518 | A1 | 6/2011 | Hase et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0229181 | A1 | 9/2011 | Iwaya et al. | |
| 2011/0229226 | A1 | 9/2011 | Tokuda et al. | |
| 2012/0002997 | A1 | 1/2012 | Hiraoka et al. | |
| 2012/0063829 | A1 | 3/2012 | Matsuyama et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0195623 | A1 | 8/2012 | Okamoto | |
| 2012/0195652 | A1 | 8/2012 | Takahashi et al. | |
| 2012/0195653 | A1 | 8/2012 | Sasaki | |
| 2012/0237273 | A1 | 9/2012 | Yoshinaga et al. | |
| 2013/0004192 | A1 | 1/2013 | Kawakami et al. | |
| 2013/0004222 | A1 | 1/2013 | Sakaya et al. | |
| 2013/0045032 | A1 | 2/2013 | Shimokawa et al. | |
| 2013/0142551 | A1 | 6/2013 | Yamano et al. | |
| 2013/0164056 | A1 | 6/2013 | Imada et al. | |
| 2013/0164059 | A1 | 6/2013 | Takagi et al. | |
| 2013/0170877 | A1 | 7/2013 | Yoshiura et al. | |
| 2013/0170879 | A1 | 7/2013 | Yoshinaga et al. | |
| 2013/0170880 | A1 | 7/2013 | Gotoh et al. | |
| 2013/0189005 | A1 | 7/2013 | Saito et al. | |
| 2013/0189008 | A1 | 7/2013 | Ishii et al. | |
| 2013/0195477 | A1 | 8/2013 | Seshita et al. | |
| 2013/0195523 | A1 | 8/2013 | Yamaji et al. | |
| 2013/0195524 | A1 | 8/2013 | Ishii et al. | |
| 2013/0202320 | A1 | 8/2013 | Hase et al. | |
| 2013/0209115 | A1 | 8/2013 | Hase et al. | |
| 2013/0209119 | A1 | 8/2013 | Yuasa et al. | |
| 2013/0209121 | A1 | 8/2013 | Uchitani et al. | |
| 2013/0209131 | A1 | 8/2013 | Uchitani et al. | |
| 2013/0209147 | A1 | 8/2013 | Ogawa et al. | |
| 2013/0251422 | A1 | 9/2013 | Iwaya et al. | |
| 2013/0266355 | A1 | 10/2013 | Yoshiura et al. | |
| 2014/0016971 | A1 | 1/2014 | Arai et al. | |
| 2014/0064804 | A1 | 3/2014 | Yamaguchi et al. | |
| 2014/0112680 | A1 | 4/2014 | Ueno et al. | |
| 2014/0119762 | A1 | 5/2014 | Suzuki et al. | |
| 2014/0193175 | A1 | 7/2014 | Kato et al. | |
| 2014/0241766 | A1 | 8/2014 | Ishii et al. | |
| 2014/0270865 | A1 | 9/2014 | Yamaji et al. | |
| 2014/0270873 | A1 | 9/2014 | Kato et al. | |
| 2014/0341624 | A1 | 11/2014 | Arai et al. | |
| 2014/0356037 | A1 | 12/2014 | Shimokawa et al. | |
| 2015/0055994 | A1 | 2/2015 | Shoji et al. | |
| 2015/0253707 | A1 | 9/2015 | Suzuki et al. | |
| 2015/0261149 | A1 | 9/2015 | Seshita et al. | |
| 2015/0261155 | A1 | 9/2015 | Yoshiura et al. | |
| 2015/0261183 | A1 | 9/2015 | Kikushima et al. | |
| 2015/0355585 | A1 | 12/2015 | Suzuki et al. | |
| 2016/0187823 | A1 | 6/2016 | Seto et al. | |
| 2016/0209789 | A1 | 7/2016 | Nozawa et al. | |
| 2016/0223961 | A1 | 8/2016 | Takagi et al. | |
| 2016/0274514 | A1 | 9/2016 | Ishii et al. | |
| 2016/0306311 | A1 | 10/2016 | Ono et al. | |
| 2016/0313684 | A1 | 10/2016 | Ikeda | |
| 2016/0334742 | A1 | 11/2016 | Kobashigawa et al. | |
| 2016/0378032 | A1 | 12/2016 | Saitoh | |
| 2016/0378033 | A1 | 12/2016 | Ishigaya et al. | |
| 2017/0248879 | A1 | 8/2017 | Ishigaya et al. | |
| 2017/0255150 | A1 | 9/2017 | Hase et al. | |
| 2017/0269526 | A1 | 9/2017 | Yuasa et al. | |
| 2018/0067431 | A1 | 3/2018 | Nanno et al. | |
| 2018/0112762 | A1 | 4/2018 | Nieda | |
| 2018/0203384 | A1 | 7/2018 | Okamoto et al. | |
| 2018/0224779 | A1 | 8/2018 | Tomita et al. | |
| 2018/0329342 | A1 | 11/2018 | Seshita et al. | |
| 2020/0241453 | A1 | 7/2020 | Okamoto et al. | |
| 2021/0223724 | A1 | 7/2021 | Imada et al. | |
| 2021/0364959 | A1 | 11/2021 | Sasaki | |
| 2021/0364962 | A1 | 11/2021 | Ikeda | |
| 2021/0364986 | A1 | 11/2021 | Okamoto | |
| 2022/0043376 | A1 | 2/2022 | Shoji et al. | |
| 2022/0091546 | A1 | 3/2022 | Saitoh | |
| 2022/0155712 | A1 | 5/2022 | Imada et al. | |

FOREIGN PATENT DOCUMENTS

| | | |
|---|---|---|
| JP | 2016-177104 | 10/2016 |
| JP | 2017-116877 | 6/2017 |
| JP | 2017-151319 | 8/2017 |
| JP | 2018-002358 | 1/2018 |
| JP | 2018-028584 | 2/2018 |
| JP | 2018-072792 | 5/2018 |
| JP | 2018-123951 | 8/2018 |
| JP | 2018-159809 | 10/2018 |

* cited by examiner

CONTACT-SEPARATION DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-111719, filed on Jul. 5, 2021, in the Japan Patent Office, the entire disclosure of which is hereby incorporated by reference herein.

BACKGROUND

Technical Field

Exemplary aspects of the present disclosure relate to a contact-separation device, a fixing device, and an image forming apparatus, and more particularly, to a contact-separation device, a fixing device incorporating the contact-separation device, and an image forming apparatus incorporating the contact-separation device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data.

Such image forming apparatuses include a contact-separation device that includes a presser and a cam. The presser presses a contact-separation member against a contacted member such that the contact-separation member separably contacts the contacted member. The cam presses the presser in an opposite direction opposite to a pressing direction in which the presser presses the contact-separation member.

SUMMARY

This specification describes below an improved contact-separation device. In one embodiment, the contact-separation device brings a contact-separation member into contact with a contacted member separably and includes a biasing member that generates a biasing force. A presser presses the contact-separation member against the contacted member in a pressing direction with the biasing force from the biasing member. A cam presses the presser in an opposite direction being opposite to the pressing direction. The cam is rotatable and has a cam face. A cam follower has a cam contact face that contacts the cam face of the cam. The cam contact face is curved to project toward the cam. The cam contact face has a curvature that is smaller than a greatest curvature of the cam face of the cam and is greater than a smallest curvature of the cam face of the cam.

This specification further describes an improved fixing device. In one embodiment, the fixing device includes a fixing rotator as a contacted member, a pressure rotator as a contact-separation member that contacts the fixing rotator separably, and the contact-separation device described above that brings the pressure rotator into contact with the fixing rotator separably.

This specification further describes an improved image forming apparatus. In one embodiment, the image forming apparatus includes a contacted member, a contact-separation member that contacts the contacted member separably, and the contact-separation device described above that brings the contact-separation member into contact with the contacted member separably.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
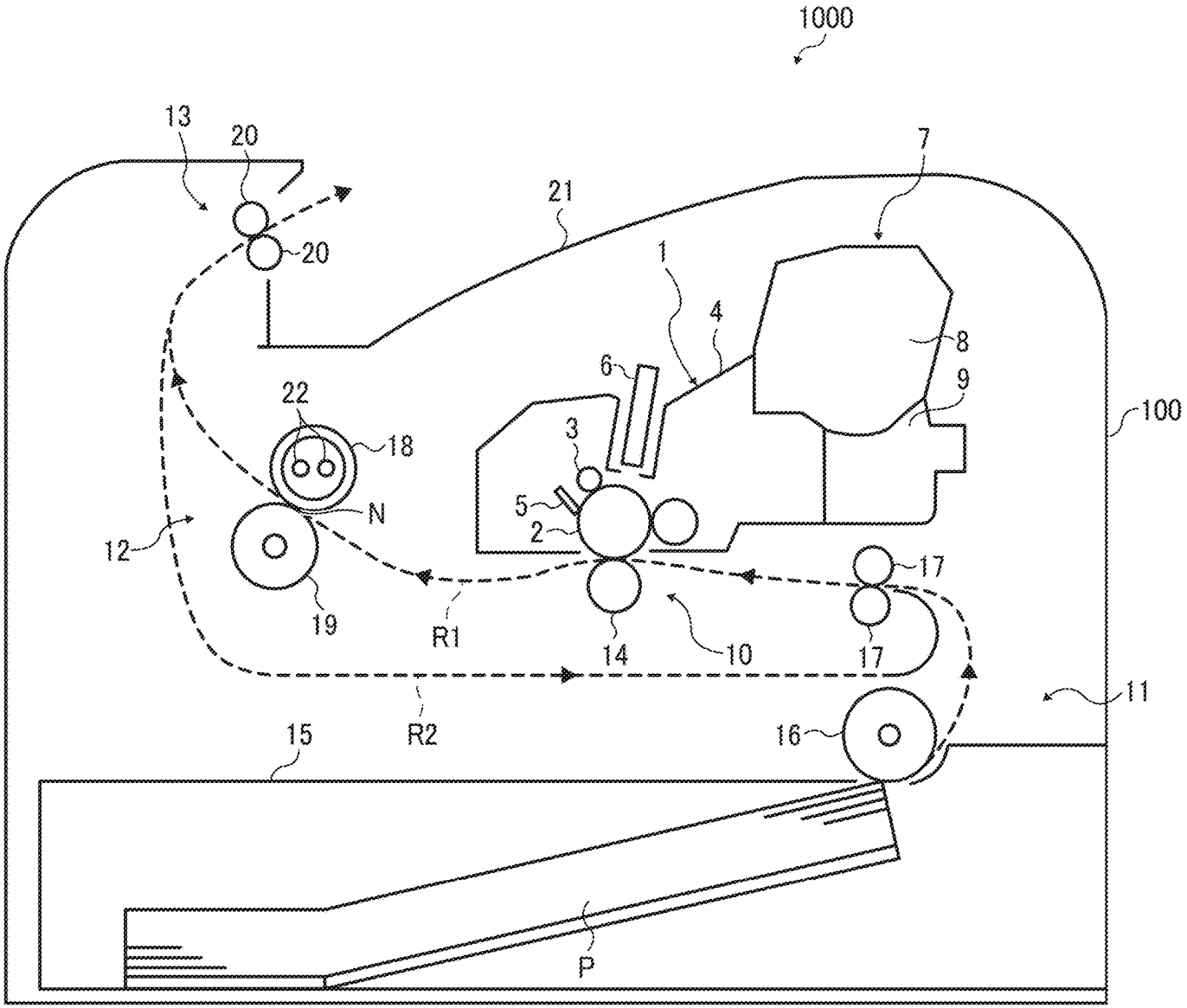
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to attached drawings, the following describes embodiments of the present disclosure. In the drawings for explaining the embodiments of the present disclosure, identical reference numerals are assigned to elements such as members and parts that have an identical function or an identical shape as long as differentiation is possible and a description of those elements is omitted once the description is provided.

A description is provided of an entire construction and operations of an image forming apparatus 1000 according to an embodiment of the present disclosure.

The image forming apparatus 1000 according to the embodiment of the present disclosure is a printer, a copier, a facsimile machine, a multifunction peripheral (MFP) having at least two of copying, printing, facsimile, scanning, and plotter functions, or the like.

FIG. 1 is a schematic cross-sectional view of the image forming apparatus 1000 according to the embodiment of the present disclosure.

The image forming apparatus 1000 illustrated in FIG. 1 is a monochrome image forming apparatus that forms a monochrome toner image. A process unit 1 serving as an image forming unit is removably installed in an apparatus body 100 of the image forming apparatus 1000.

The process unit 1 includes a photoconductor 2, a charging roller 3, and a developing device 4. The photoconductor 2 serves as an image bearer that bears an image (e.g., a toner image) on a surface of the photoconductor 2. The charging roller 3 serves as a charger that charges the surface of the photoconductor 2. The developing device 4 serves as a developing unit that visualizes a latent image formed on the surface of the photoconductor 2 into a toner image. The process unit 1 further includes a cleaning blade 5 serving as a cleaner that cleans the surface of the photoconductor 2. A light-emitting diode (LED) head array 6 is disposed opposite the photoconductor 2 and serves as an exposure device that exposes the surface of the photoconductor 2.

A toner cartridge 7 is removably mounted on the process unit 1 and serves as a powder container that contains toner as particles used to form the toner image. The toner cartridge 7 includes a fresh toner container 8 that contains fresh toner (e.g., unused toner) and a waste toner container 9 that contains waste toner (e.g., used toner).

The image forming apparatus 1000 further includes a transfer device 10, a sheet feeder 11, and a fixing device 12. The transfer device 10 transfers the toner image onto a sheet P serving as a recording medium. The sheet feeder 11 supplies the sheet P to the transfer device 10. The fixing device 12 fixes the toner image transferred onto the sheet P thereon. The image forming apparatus 1000 further includes an output device 13 that outputs the sheet P to an outside of the apparatus body 100 and a registration roller pair 17 serving as a timing roller pair.

The transfer device 10 includes a transfer roller 14 serving as a transferor. The transfer roller 14 contacts the photoconductor 2 in a state in which the process unit 1 is installed in the apparatus body 100. The transfer roller 14 is coupled with a power supply that applies at least one of a predetermined direct current (DC) voltage and a predetermined alternating current (AC) voltage to the transfer roller 14.

The sheet feeder 11 includes a sheet tray 15 (e.g., a paper tray) that loads a plurality of sheets P and a feed roller 16 that picks up and feeds a sheet P from the sheet tray 15. The sheets P include, in addition to plain paper, thick paper, thin paper, a postcard, an envelope, coated paper, art paper, and tracing paper. Further, instead of paper, an overhead projector (OHP) transparency (e.g., an OHP sheet and OHP film) and the like may be used as recording media.

The fixing device 12 includes a pair of rotators, that is, two rotators that are disposed opposite each other. One of the rotators is a fixing roller 18 serving as a fixing rotator that fixes the toner image on the sheet P. Another one of the rotators is a pressure roller 19 serving as a pressure rotator that presses against the fixing roller 18. Halogen heaters 22 serving as heaters are disposed inside the fixing roller 18. The fixing roller 18 and the pressure roller 19 contact each other to form a fixing nip N therebetween.

The output device 13 includes an output roller pair 20 that ejects the sheet P onto the outside of the apparatus body 100. An output tray 21 is disposed on a top face of an exterior of the apparatus body 100 and is placed with the sheet P ejected by the output roller pair 20.

A conveyance path R1 is disposed inside the apparatus body 100. The conveyance path R1 extends from the sheet tray 15 to the output roller pair 20 through the registration roller pair 17, an image transfer portion (e.g., a transfer nip) formed between the transfer roller 14 and the photoconductor 2, and the fixing device 12. The sheet P is conveyed through the conveyance path R1. A duplex conveyance path R2 is disposed inside the apparatus body 100 of the image forming apparatus 1000. During duplex printing, the sheet P that has passed the fixing device 12 is conveyed through the duplex conveyance path R2 to the image transfer portion again.

Referring to FIG. 1, a description is provided of an image forming operation of the image forming apparatus 1000 according to this embodiment.

When the image forming operation starts, a driver drives and rotates the photoconductor 2. The charging roller 3 charges the surface of the photoconductor 2 uniformly at a predetermined polarity. The LED head array 6 exposes the charged surface of the photoconductor 2 according to image data sent from a reading device, a client computer, or the like, thus forming an electrostatic latent image on the surface of the photoconductor 2. The developing device 4 supplies toner to the electrostatic latent image formed on the photoconductor 2, visualizing the electrostatic latent image as a visible toner image.

When the image forming operation starts, the driver starts driving and rotating the feed roller 16 to feed a sheet P from the sheet tray 15. The registration roller pair 17 interrupts conveyance of the sheet P sent from the feed roller 16. Thereafter, at a predetermined time, the driver resumes driving and rotating the registration roller pair 17. The registration roller pair 17 conveys the sheet P to the image transfer portion at a time when the toner image formed on the photoconductor 2 reaches the image transfer portion.

When the sheet P reaches the image transfer portion, a predetermined voltage is applied to the transfer roller 14 to generate a transfer electric field. The transfer electric field transfers the toner image formed on the photoconductor 2 onto the sheet P. The cleaning blade 5 removes toner failed to be transferred onto the sheet P and therefore remaining on the photoconductor 2 therefrom. The removed toner is conveyed and collected into the waste toner container 9 of the toner cartridge 7.

The sheet P transferred with the toner image is conveyed to the fixing device 12. As the sheet P bearing the toner image is conveyed through the fixing nip N formed between the fixing roller 18 and the pressure roller 19, the fixing roller 18 and the pressure roller 19 fix the toner image on the sheet P under heat and pressure. The output roller pair 20 ejects the sheet P onto the outside of the apparatus body 100. Thus, the sheet P is placed on the output tray 21.

If the image forming apparatus 1000 receives a print job that instructs duplex printing, the sheet P that has passed the fixing device 12 is not ejected onto the outside of the apparatus body 100 and is switched back and conveyed to the duplex conveyance path R2. The sheet P is conveyed through the duplex conveyance path R2 and is conveyed into the conveyance path R1 at a position in front of the registration roller pair 17. The registration roller pair 17 conveys the sheet P to the image transfer portion again. At the image transfer portion, the transfer roller 14 transfers a toner image onto a back side of the sheet P. The fixing device 12 fixes the toner image on the back side of the sheet P. Thereafter, the output roller pair 20 ejects the sheet P onto the outside of the apparatus body 100.

Figure 2:
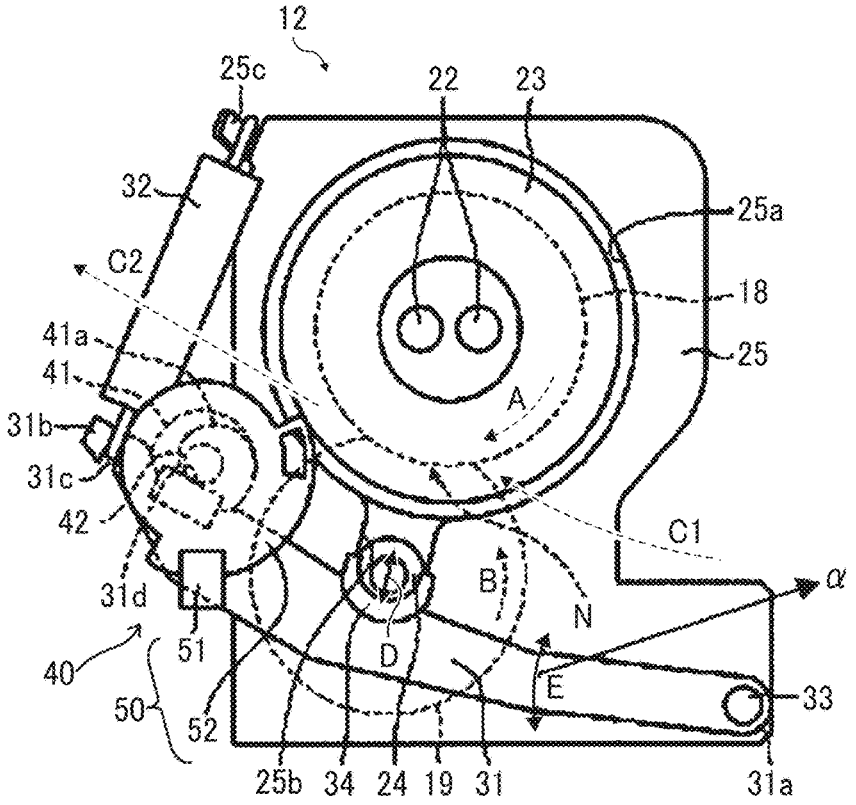
FIG. 2 is a schematic cross-sectional view of a fixing device incorporated in the image forming apparatus depicted in FIG. 1.

FIG. 2 is a schematic cross-sectional view of the fixing device 12 according to this embodiment.

A pair of supports 25 rotatably supports both lateral ends of each of the fixing roller 18 and the pressure roller 19 in an axial direction thereof via bearings 23 and 24, respectively. As a driving force is transmitted from the driver disposed inside the apparatus body 100 to the fixing roller 18, the fixing roller 18 is driven and rotated in a rotation direction A. The pressure roller 19 is driven and rotated in a rotation direction B in accordance with rotation of the fixing roller 18. According to this embodiment, the fixing roller 18 serves as a driving roller and the pressure roller 19 serves as a driven roller. Alternatively, the pressure roller 19 may serve as a driving roller and the fixing roller 18 may serve as a driven roller.

In a state in which the fixing roller 18 is heated to a predetermined temperature with radiant heat generated by the halogen heaters 22, as the sheet P enters the fixing nip N in a sheet conveyance direction C1, the fixing roller 18 and the pressure roller 19, which rotate, convey the sheet P while the fixing roller 18 and the pressure roller 19 sandwich the sheet P. The fixing roller 18 heated by the halogen heaters 22 heats an unfixed toner image on the sheet P. Simultaneously, the fixing roller 18 and the pressure roller 19 press the sheet P, fixing the unfixed toner image on the sheet P. The sheet P bearing the fixed toner image is ejected from the fixing nip N in a sheet conveyance direction C2.

The supports 25 support the pressure roller 19 such that the pressure roller 19 comes into contact with and separates from the fixing roller 18 in a contact-separation direction D. For example, the bearing 24 that supports the pressure roller 19 is fitted in a bearing guide 25*b* as a rectangular hole disposed in each of the supports 25. As the bearing guide 25*b* guides the bearing 24, the pressure roller 19 comes into contact with and separates from the fixing roller 18. Conversely, the bearing 23 that supports the fixing roller 18 is fitted in a bearing engagement 25*a* as a circular hole disposed in each of the supports 25. Thus, the fixing roller 18 is secured to the bearing engagement 25*a* via the bearing 23 such that a shaft of the fixing roller 18 does not move in a direction perpendicular to the axial direction of the fixing roller 18.

The fixing device 12 according to this embodiment further includes a contact-separation device 40 serving as a contact and separation mechanism that brings the pressure roller 19 serving as a contact-separation member into contact with the fixing roller 18 serving as a contacted member and separates the pressure roller 19 from the fixing roller 18.

The contact-separation device 40 includes cams 41, pressure levers 31 serving as pressers, and pressure springs 32 serving as biasing members.

The single pressure lever 31 and the single pressure spring 32 are disposed at each lateral end of the pressure roller 19 in the axial direction thereof. The pressure lever 31 includes a supported end 31*a*, that is, one end, which is supported by a support shaft 33 mounted on a lower portion of the support 25. The pressure lever 31 is pivotable about the support shaft 33 in a pivot direction E. Each of the pressure springs 32 is anchored to or hooked on hooks 31*c* and 25*c* that are disposed on a biased end 31*b*, that is, another end, of the pressure lever 31 and an upper portion of the support 25, respectively. Accordingly, the pressure spring 32 constantly holds and pulls the biased end 31*b* of the pressure lever 31 upward in FIG. 2. The pressure lever 31 presses the bearing 24 that supports the pressure roller 19 through a pad 34 fitted in the bearing guide 25*b* of the support 25, thus pressing the pressure roller 19 against the fixing roller 18.

The cams 41 are mounted on both lateral ends of a rotation shaft 42 in an axial direction thereof, respectively, which is rotatably supported by the pair of supports 25. As the rotation shaft 42 rotates, the pair of cams 41 rotates together with the rotation shaft 42. Each of the cams 41 includes a cam face 41*a* defining a distance from a center of rotation of the cam 41, which varies in a rotation direction of the cam 41. The cam 41 is made of a resin material that is processed readily and available at reduced costs. The cam 41 made of the resin material reduces manufacturing costs and saves space.

The cam face 41*a* of the cam 41 contacts a cam follower 31*d* that is made of resin and mounted on the pressure lever 31.

As the pressure spring 32 pulls the pressure lever 31, the pressure lever 31 holds the cam follower 31*d* mounted on the pressure lever 31 in a state in which the cam follower 31*d* contacts the cam face 41*a* of the cam 41. Accordingly, as the cam 41 rotates forward in one direction, the cam face 41*a* presses the pressure lever 31 downward in FIG. 2, separating the pressure roller 19 from the fixing roller 18. As the cam 41 rotates backward, a biasing force from the pressure spring 32 returns the pressure lever 31 upward in FIG. 2, bringing the pressure roller 19 into contact with the fixing roller 18.

The fixing device 12 according to this embodiment further includes a rotation position detector 50 (e.g., a rotation position detecting mechanism) that detects a rotation position (e.g., a rotation angle) of the cam 41. The rotation position detector 50 includes an optical sensor 51 and a light shield 52. The optical sensor 51 is a transmission type optical sensor. The optical sensor 51 includes a light emitter that emits light and a light receiver that receives the light emitted by the light emitter. As the light shield 52 rotates together with the cam 41, the light shield 52 blocks the light emitted by the optical sensor 51 or allows the light to transmit, prohibiting the light receiver from receiving the light or causing the light receiver to receive the light. Hence, the light shield 52 serves as a detected member of which rotation position is detected by the optical sensor 51. The optical sensor 51 and the light shield 52 are mounted on one of the two cams 41.

Figure 3:
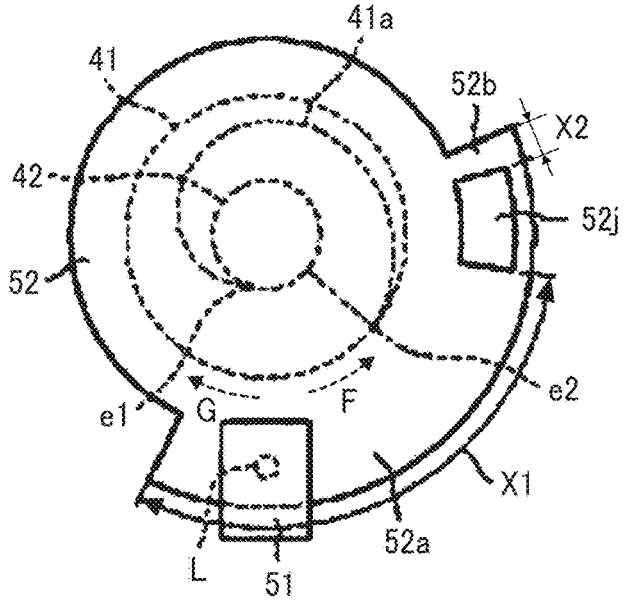
FIG. 3 is a diagram of a cam, a light shield, and an optical sensor incorporated in the fixing device depicted in FIG. 2.

FIG. 3 is a diagram of the cam 41, the light shield 52, and the optical sensor 51 of the fixing device 12 depicted in FIG. 2.

As illustrated in FIG. 3, the cam face 41*a* of the cam 41 gradually increases a distance from the center of rotation of the cam 41 clockwise in FIG. 3. The cam face 41*a* is disposed in a region (e.g., a span) greater than a semicircular region defining an angle of 180 degrees in the rotation direction of the cam 41. For example, according to this embodiment, the cam face 41*a* is disposed in a region (e.g., a span) that extends from a decreased distance point e1 (e.g., a smallest distance point) to an increased distance point e2 (e.g., a greatest distance point) and defines an angle of about 220 degrees. The distance from the center of rotation of the cam 41 to the cam face 41*a* is smallest at the decreased distance point e1 and is greatest at the increased distance point e2.

The light shield 52 includes an increased light shield portion 52*a* and a decreased light shield portion 52*b*. The increased light shield portion 52*a* serves as a detected region that has an increased length X1 in the rotation direction of the cam 41. The decreased light shield portion 52*b* serves as a detected region that has a decreased length X2 that is smaller than the increased length X1 of the increased light shield portion 52*a* in the rotation direction of the cam 41. As the light shield 52 mounted on the cam 41 rotates, the increased light shield portion 52*a* and the decreased light shield portion 52*b* pass over a light emitting portion L of the optical sensor 51, blocking the light emitted from the optical sensor 51. A hole 52*j* (e.g., a light transmitting portion) through which the light emitted from the optical sensor 51 is transmitted is interposed between the increased light shield portion 52*a* and the decreased light shield portion 52*b*.

Figure 4:
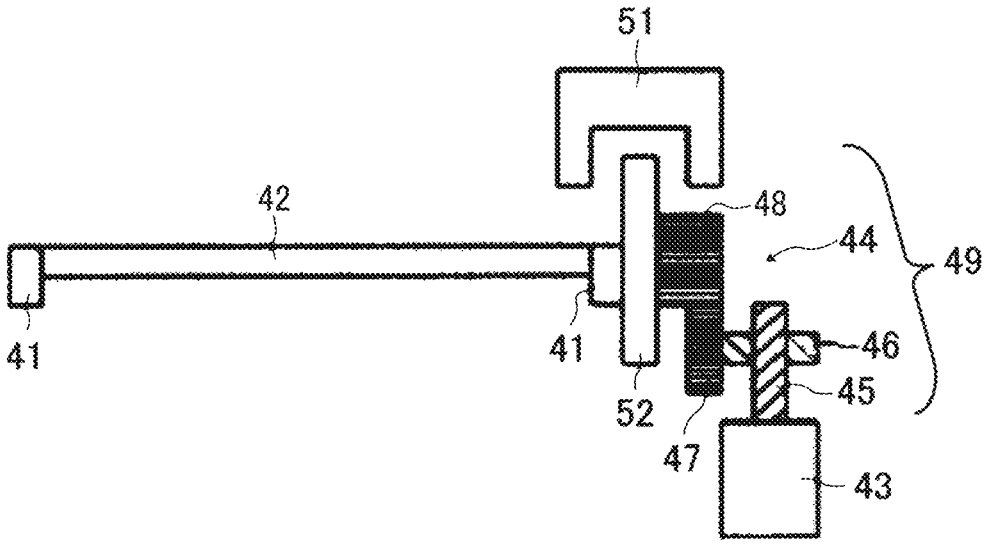
FIG. 4 is a schematic diagram of a cam driver that drives the cam depicted in FIG. 3.

FIG. 4 is a schematic diagram of a cam driver 49 that drives the cam 41 according to this embodiment.

As illustrated in FIG. 4, the cam driver 49 includes a motor 43 serving as a driver and a gear train 44 that transmits a driving force from the motor 43 to the cam 41 and the light shield 52. The motor 43 is a brushed direct current (DC) motor that is compact and is available at reduced costs. The gear train 44 includes a first worm gear 45 and a second worm gear 46. The first worm gear 45 is mounted on an output shaft of the motor 43. The second worm gear 46 meshes with the first worm gear 45. The gear train 44 further includes a first spur gear 47 and a second spur gear 48. The first spur gear 47 is combined with the second worm gear 46. The second spur gear 48 meshes with the first spur gear 47 and is combined with the light shield 52. As the output shaft of the motor 43 rotates forward in one direction or backward in an opposite direction, each of the first worm gear 45 and the second worm gear 46 and each of the first spur gear 47 and the second spur gear 48 rotate. The second spur gear 48 and the light shield 52, which rotate together, rotate each of the cams 41 through the rotation shaft 42 in one direction (e.g., a rotation direction F depicted in FIG. 3) or an opposite direction (e.g., a rotation direction G opposite to the rotation direction F).

Figure 5:
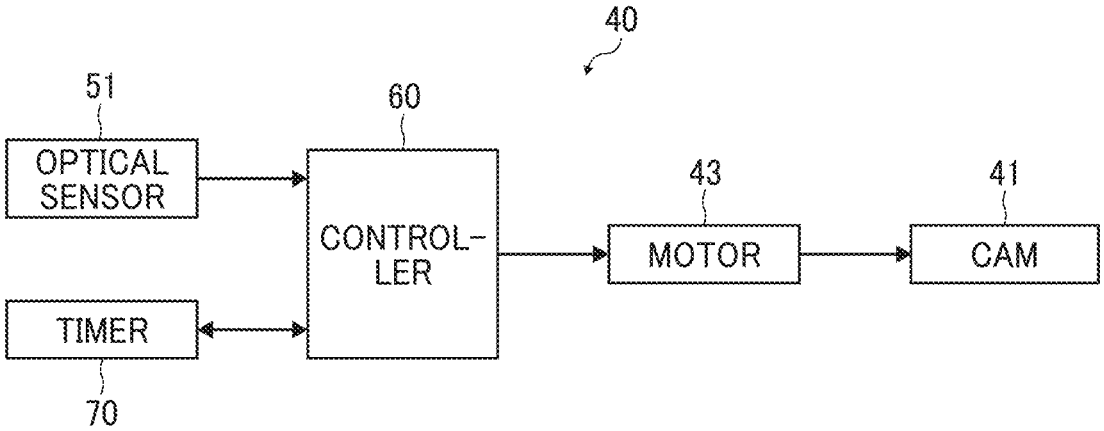
FIG. 5 is a block diagram of a control system of a contact-separation device incorporated in the fixing device depicted in FIG. 2.

FIG. 5 is a block diagram of a control system of the contact-separation device 40 according to this embodiment.

As illustrated in FIG. 5, the control system includes a controller 60, the optical sensor 51, and a timer 70. The controller 60 controls rotation of the cam 41. The optical sensor 51 detects the rotation position of the cam 41. The timer 70 counts a rotation time of the cam 41. For example, the controller 60 includes a central processing unit (CPU), a read only memory (ROM), and a random access memory (RAM) that are disposed inside the apparatus body 100. The controller 60 controls driving of the motor 43 based on a detection signal sent from the optical sensor 51 and a time counted by the timer 70 so as to control rotation of the cam 41. The controller 60 also controls a start time at which the timer 70 starts counting and a stop time at which the timer 70 stops counting based on the detection signal sent from the optical sensor 51.

In the fixing device 12 according to this embodiment, the pressure roller 19 comes into contact with and separates from the fixing roller 18 so as to change pressure applied at the fixing nip N according to a type of the sheet P. The following describes a pressure releasing operation for releasing normal pressure and a pressing operation for retrieving the normal pressure.

Figure 6A:
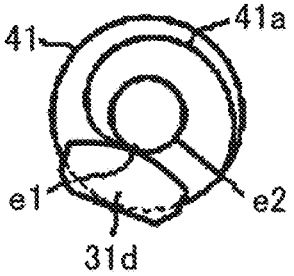
FIG. 6A is a diagram of the cam depicted in FIG. 3, illustrating one of processes for releasing pressure from normal pressure.
Figure 6B:
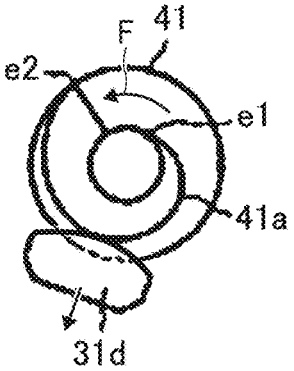
FIG. 6B is a diagram of the cam depicted in FIG. 6A, illustrating another one of the processes for releasing pressure from the normal pressure.
Figure 6C:
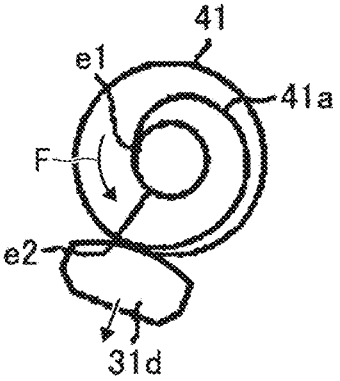
FIG. 6C is a diagram of the cam depicted in FIG. 6A, illustrating yet another one of the processes for releasing pressure from the normal pressure.

FIGS. 6A, 6B, and 6C are diagrams of the cam 41, illustrating the pressure releasing operation for releasing the normal pressure.

As illustrated in FIG. 6A, the cam follower 31*d* mounted on the pressure lever 31 contacts the cam face 41*a* of the cam 41 at the decreased distance point e1 under the normal pressure from the cam 41.

The controller 60 controls the motor 43 to drive and rotate the cam 41 from a position illustrated in FIG. 6A counterclockwise in FIG. 6B in the rotation direction F. As the cam 41 rotates, the cam face 41*a* slides over the cam follower 31*d*. Thus, a contact position where the cam face 41*a* contacts the cam follower 31*d* changes. The cam 41 and the cam follower 31*d* are made of resin that facilitates sliding of the cam face 41*a* over the cam follower 31*d*, such as polyoxymethylene (POM). Accordingly, the cam 41 and the cam follower 31*d* are immune from abrasion and the cam face 41*a* slides over the cam follower 31*d* properly.

As the cam 41 rotates, the light shield 52 also rotates counterclockwise in FIG. 3 in the rotation direction F. The light shield 52 does not block the light emitted from the optical sensor 51. The optical sensor 51 does not detect the light shield 52. The controller 60 controls the timer 70 to start counting a time when the motor 43 starts rotating. If the detection signal from the optical sensor 51 does not change, that is, if the light shield 52 does not switch from a light blocking state to a light transmitting state, until a predetermined time, the controller 60 determines that a failure occurs and interrupts operation.

As the cam 41 rotates counterclockwise in FIG. 6B in the rotation direction F, the cam face 41*a* presses the cam follower 31*d* downward in FIG. 6B. Accordingly, the pressure lever 31 pivots and retracts from the bearing 24 supporting the pressure roller 19. Consequently, the pressure roller 19 moves and separates from the fixing roller 18.

As the light shield 52 rotates counterclockwise in FIG. 3 in the rotation direction F together with the cam 41, immediately before the increased distance point e2 on the cam face 41*a* reaches the contact position where the cam face 41*a* contacts the cam follower 31*d*, the decreased light shield portion 52*b* of the light shield 52 reaches an opposed position where the decreased light shield portion 52*b* is disposed opposite the optical sensor 51. Accordingly, the decreased light shield portion 52*b* blocks the light emitted from the optical sensor 51. The detection signal from the optical sensor 51 changes, that is, the light shield 52 switches from the light transmitting state to the light blocking state. Thereafter, the hole 52*j* (e.g., the light transmitting portion) of the light shield 52 reaches an opposed position where the hole 52*j* is disposed opposite the optical sensor 51 immediately. The detection signal from the optical sensor 51 changes, that is, the light shield 52 switches from the light blocking state to the light transmitting state. At a time when the detection signal from the optical sensor 51 changes, that is, when the light shield 52 switches from the light blocking state to the light transmitting state, the controller 60 controls the motor 43 to interrupt driving. Accordingly, at a time when the increased distance point e2 on the cam face 41*a* reaches the contact position where the cam face 41*a* contacts the cam follower 31*d* as illustrated in FIG. 6C, the cam 41 interrupts rotation. Thus, separation of the pressure roller 19 from the fixing roller 18 is completed and the pressure roller 19 and the fixing roller 18 are in a pressure releasing state in which the pressure roller 19 and the fixing roller 18 release pressure applied at the fixing nip N.

Figure 7A:
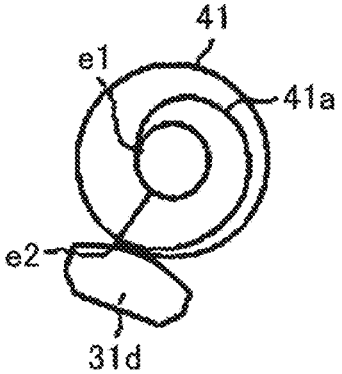
FIG. 7A is a diagram of the cam depicted in FIG. 3, illustrating one of processes for retrieving the normal pressure from a pressure releasing state.
Figure 7B:
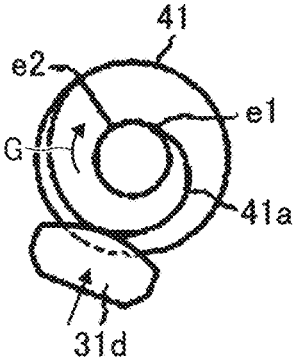
FIG. 7B is a diagram of the cam depicted in FIG. 7A, illustrating another one of the processes for retrieving the normal pressure from the pressure releasing state.
Figure 7C:
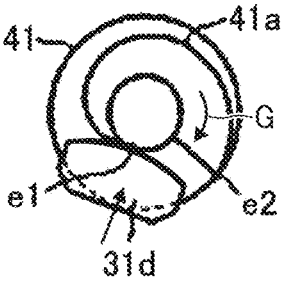
FIG. 7C is a diagram of the cam depicted in FIG. 7A, illustrating yet another one of the processes for retrieving the normal pressure from the pressure releasing state.

FIGS. 7A, 7B, and 7C are diagrams of the cam 41, illustrating the pressing operation for retrieving the normal pressure from the pressure releasing state.

The controller 60 controls the motor 43 to rotate the cam 41 in the rotation direction G that is opposite to the rotation direction F in which the motor 43 rotates the cam 41 to release pressure. The motor 43 rotates the cam 41 in the pressure releasing state depicted in FIG. 7A clockwise as illustrated in FIG. 7B in the rotation direction G that is opposite to the rotation direction F depicted in FIG. 6B in which the cam 41 rotates to release pressure as described above. Accordingly, the cam face 41*a* slides over the cam follower 31*d*. The contact position where the cam face 41*a* contacts the cam follower 31*d* moves relatively from the increased distance point e2 to the decreased distance point e1. Accordingly, the biasing force from the pressure spring 32 lifts the cam follower 31*d* upward in FIG. 7C. The pressure lever 31 presses the bearing 24 supporting the pressure roller 19. Consequently, the pressure roller 19 moves closer to the fixing roller 18.

As the controller 60 controls the motor 43 to rotate the cam 41 in the rotation direction G that is opposite to the rotation direction F in which the motor 43 rotates the cam 41 to release pressure, the light shield 52 also rotates together with the cam 41. Before the decreased distance point e1 on the cam face 41*a* reaches the contact position where the cam face 41*a* contacts the cam follower 31*d*, one end of the increased light shield portion 52*a* reaches an opposed position where the increased light shield portion 52*a* is disposed opposite the optical sensor 51, thus blocking the light from the optical sensor 51. Accordingly, the detection signal from the optical sensor 51 changes, that is, the light shield 52 switches from the light transmitting state to the light blocking state. At the time when the detection signal from the optical sensor 51 changes, the controller 60 controls the timer 70 to start counting the time when the motor 43 starts rotating. When the counted time reaches a preset time, the controller 60 controls the motor 43 to interrupt driving. Accordingly, at a time when the decreased distance point e1 on the cam face 41*a* reaches the contact position where the cam face 41*a* contacts the cam follower 31*d* as illustrated in FIG. 7C, the cam 41 interrupts rotation. Thus, pressing of the pressure roller 19 against the fixing roller 18 is completed and the pressure roller 19 and the fixing roller 18 return to a pressing state in which the pressure roller 19 and the fixing roller 18 retrieve the normal pressure applied at the fixing nip N.

As described above, in the fixing device 12, the cam 41 rotates in one direction (e.g., the rotation direction F) to separate the pressure roller 19 from the fixing roller 18. The cam 41 rotates in an opposite direction (e.g., the rotation direction G) to move the pressure roller 19 closer to the fixing roller 18. The identical cam face 41*a* is used to press and move the pressure lever 31 and return the pressure lever 31.

The cam 41 releases the normal pressure to decrease pressure so as to facilitate removal of the sheet P jammed at the fixing nip N or to decrease pressure after the sheet P passes through the fixing nip N so as to suppress plastic deformation of the pressure roller 19 and the fixing roller 18 due to pressure, for example. Alternatively, the cam 41 may release pressure to separate the pressure roller 19 from the fixing roller 18 such that the pressure roller 19 does not contact the fixing roller 18.

The cam 41 preferably changes pressure applied at the fixing nip N according to the type of the sheet P conveyed through the fixing nip N. For example, when two-ply sheets such as an envelope are conveyed through the fixing nip N, if the cam 41 causes the pressure roller 19 to press against the fixing roller 18 with pressure equivalent to pressure with which the pressure roller 19 and the fixing roller 18 sandwich plain paper, the two-ply sheets may crease. To address this circumstance, when the two-ply sheets such as the envelope are conveyed through the fixing nip N, the cam 41 causes the pressure roller 19 to press against the fixing roller 18 to form the fixing nip N with pressure smaller than the normal pressure with which the pressure roller 19 and the fixing roller 18 sandwich the plain paper conveyed through the fixing nip N.

Hence, the cam 41 stops at three stop positions described below. For example, the cam 41 stops at a first stop position depicted in FIG. 6A, that is, a stop position in a normal pressure application state, where the decreased distance point e1 on the cam face 41*a* contacts the cam follower 31*d*. The cam 41 stops at a second stop position depicted in FIG. 6C, that is, a stop position in the pressure releasing state, where the increased distance point e2 on the cam face 41*a* contacts the cam follower 31*d*. The cam 41 stops at a third stop position depicted in FIG. 6B that provides a plurality of stop positions corresponding to pressure that varies depending on the type of the sheet P. The plurality of stop positions corresponding to pressure that varies depending on the type of the sheet P is set between the decreased distance point e1 and the increased distance point e2 on the cam face 41*a*.

If the plurality of stop positions is set between the decreased distance point e1 and the increased distance point e2 on the cam face 41*a*, a decreased light shield portion is disposed at a position corresponding to a stop position in a light transmitting region interposed between one end of the increased light shield portion 52*a* and the decreased light shield portion 52*b* of the light shield 52. The controller 60 controls the motor 43 to interrupt driving at a time when the detection signal from the optical sensor 51 changes, that is, when the light transmitting state switches to the light blocking state. Thus, the motor 43 stops the cam 41 at the stop position corresponding to pressure that varies depending on the type of the sheet P.

Figure 8:
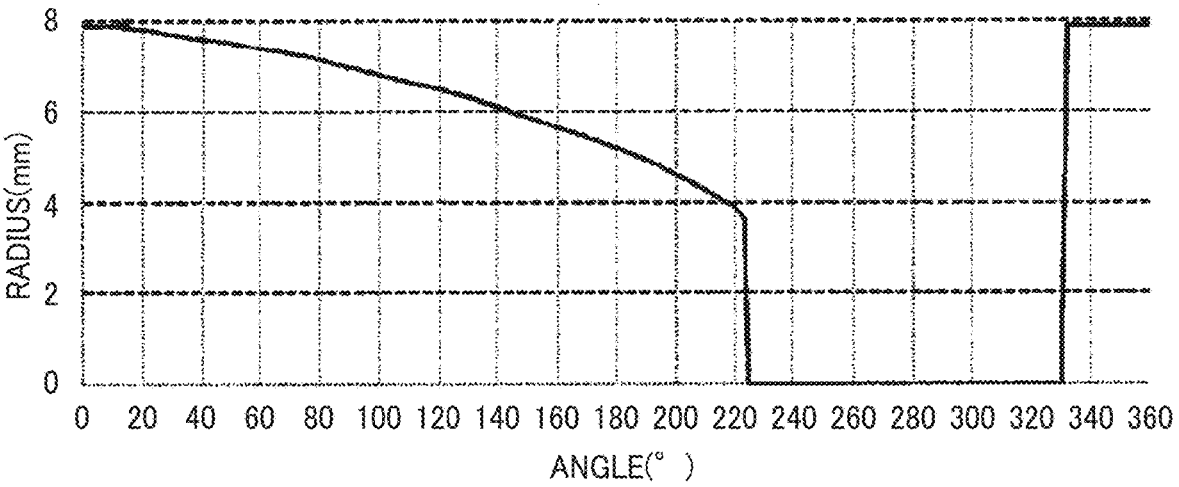
FIG. 8 is a cam diagram of the cam depicted in FIG. 3.

FIG. 8 is a cam diagram of the cam 41.

In the cam diagram in FIG. 8, the increased distance point e2 on the cam face 41*a* defines zero degree.

Figure 9A:
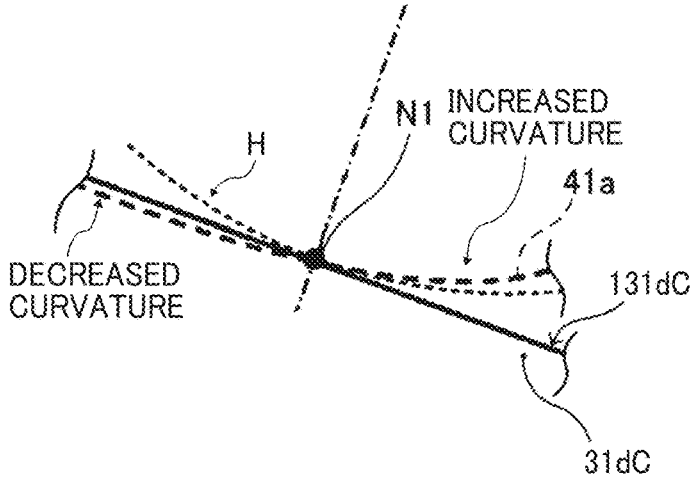
FIG. 9A is a diagram of a cam face of the cam depicted in FIG. 3, illustrating displacement of a contact position where the cam face contacts a comparative cam contact face of a comparative cam follower, which is planar.
Figure 9B:
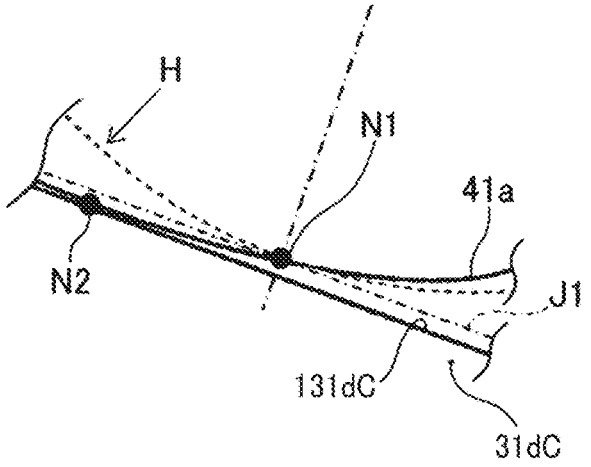
FIG. 9B is another diagram of the cam face of the cam depicted in FIG. 9A.
Figure 9C:
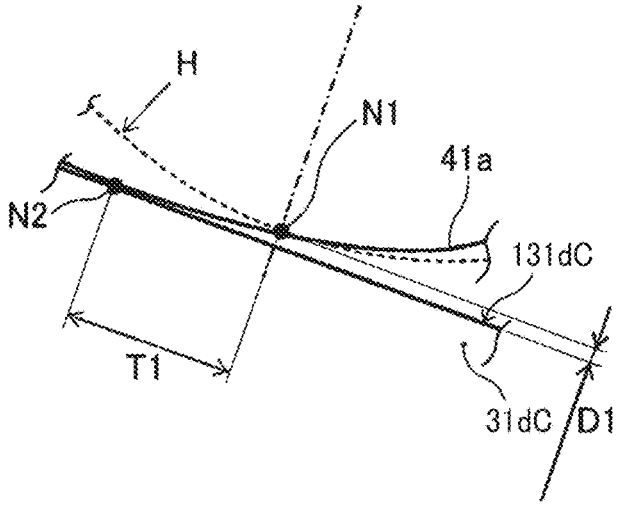
FIG. 9C is yet another diagram of the cam face of the cam depicted in FIG. 9A.

In order to move the cam 41 smoothly, the cam face 41*a* defines a sine curve illustrated in FIGS. 9A, 9B, and 9C. As a load imposed on the cam face 41*a* increases, a change on the cam face 41*a* decreases, so as to prevent sharp change in the load when an increased load is imposed on the cam face 41*a*, stabilize motion of the cam 41, decrease the load imposed on the motor 43, and prevent noise, or the like. As a result, as the load imposed on the cam face 41*a* decreases, a curvature of the cam face 41*a* increases. As the load imposed on the cam face 41*a* increases, the curvature of the cam face 41*a* decreases. As illustrated in the cam diagram in FIG. 8 also, as a radius of the cam 41 increases at a position in proximity to the increased distance point e2 at an angle of zero degree in FIG. 8, inclination of the cam face 41*a* decreases gradually.

A description is provided of a construction of a comparative contact-separation device.

The comparative contact-separation device includes a cam including a cam face that contacts a cam contact face of a presser. The cam contact face is planar.

However, when the cam stops at a predetermined position, the cam face of the cam may contact the cam contact face of the presser at a position on the cam face, which is different from a target contact position where the cam face contacts the cam contact face. Hence, the presser may not move a contact-separation member to a target position precisely.

For example, as illustrated in FIGS. 9A, 9B, and 9C, in the comparative contact-separation device, the cam face 41*a* contacts a cam contact face 131*d*C of a cam follower 31*d*C. The cam contact face 131*d*C is planar. If the cam contact face 131*d*C is planar, even if the cam 41 stops at a predetermined rotation position precisely, the cam face 41*a* may contact the cam contact face 131*d*C at a position on the cam face 41*a*, which is different from a target contact position where the cam face 41*a* contacts the cam contact face 131*d*C. Accordingly, the cam 41 may not press the pressure lever 31 with a target pressing amount, displacing the pressure roller 19 from a target position. Consequently, the pressure roller 19 may not press the fixing roller 18 with target pressure at the fixing nip N, degrading fixing of the toner image on the sheet P.

A description is provided of reasons why the cam face 41*a* contacts the cam contact face 131*d*C of the cam follower 31*d*C at the position on the cam face 41*a*, which is different from the target contact position where the cam face 41*a* contacts the cam contact face 131*d*C, if the cam contact face 131*d*C is planar.

Referring to FIGS. 9A, 9B, and 9C, a description is provided of displacement of the contact position where the cam face 41*a* contacts the cam contact face 131*d*C that is planar.

In FIG. 9A, a fine broken line H indicates an arc as a rough standard drawn with a curvature at the target contact position on the cam face 41*a*. A bold broken line indicates the cam face 41*a*. The bold broken line (e.g., the cam face 41*a*) in a left side in FIG. 9A on the left of a target contact position N1 has the increased distance point e2. In the left side in FIG. 9A, an outer diameter of the cam 41 increases, that is, the distance from the center of rotation of the cam 41 to the cam face 41*a* increases. The bold broken line (e.g., the cam face 41*a*) in a right side in FIG. 9A on the right of the target contact position N1 has the decreased distance point e1. In the right side in FIG. 9A, the outer diameter of the cam 41 decreases, that is, the distance from the center of rotation of the cam 41 to the cam face 41*a* decreases.

As described above, the cam 41 has a decreased curvature in the left side in FIG. 9A having the increased distance point e2 where the load imposed on the cam face 41*a* increases. The cam 41 has an increased curvature in the right side in FIG. 9A having the decreased distance point e1 where the load imposed on the cam face 41*a* decreases. Hence, as illustrated in FIG. 9A, the cam face 41*a* in the left side in FIG. 9A on the left of the target contact position N1 is situated closer to the cam follower 31*d*C than the arc as the rough standard indicated with the fine broken line H. The cam face 41*a* in the right side in FIG. 9A on the right of the target contact position N1 is situated farther from the cam follower 31*d*C than the arc as the rough standard indicated with the fine broken line H.

As illustrated in FIG. 9A, the cam face 41*a* in the left side in FIG. 9A on the left of the target contact position N1 engages the cam follower 31*d*C.

However, the cam face 41*a* does not actually engage the cam follower 31*d*C as illustrated in FIG. 9A. Hence, as illustrated in FIG. 9B, the cam face 41*a* contacts the cam contact face 131*d*C at an actual contact position N2 in the left side in FIG. 9B, having the increased distance point e2, on the left of the target contact position N1. The target contact position N1 on the cam face 41*a* separates from the cam contact face 131*d*C.

An outer diameter of the cam 41 at the actual contact position N2 on the cam face 41*a*, where the cam face 41*a* actually contacts the cam contact face 131*d*C, is greater than an outer diameter of the cam 41 at the target contact position N1 on the cam face 41*a*. Hence, the cam contact face 131*d*C is disposed lower than a target position J1 in FIG. 9B.

For example, as illustrated in FIG. 9C, if the cam contact face 131*d*C is planar, the actual contact position N2 on the cam face 41*a*, where the cam face 41*a* contacts the cam contact face 131*d*C, shifts by a distance T1 from the target contact position N1 leftward in the left side in FIG. 9C having the increased distance point e2 on the cam face 41*a*. As the actual contact position N2 on the cam face 41*a* shifts by the distance T1, the cam 41 presses the cam follower 31*d*C with a pressing amount increased by an amount corresponding to a length D1. Accordingly, the pressure lever 31 may press the pressure roller 19 with the pressing amount smaller than the target pressing amount. Consequently, the pressure roller 19 may press the fixing roller 18 at the fixing nip N with pressure smaller than the target pressure.

As one of workarounds for this problem, an angle of the cam follower 31*d*C may change such that the cam contact face 131*d*C of the cam follower 31*d*C separates from the cam face 41*a* in the left side in FIG. 9C on the left of the target contact position N1 so that the cam face 41*a* contacts the cam contact face 131*d*C at the target contact position N1 on the cam face 41*a*. However, the comparative contact-separation device may not employ the workaround described above due to a layout or the like of the comparative contact-separation device.

Figure 10A:
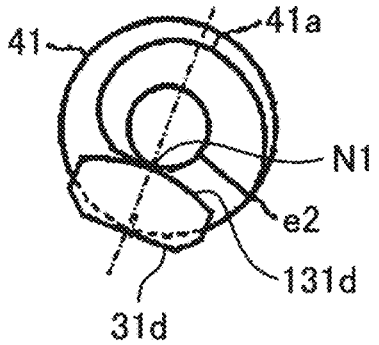
FIG. 10A is a diagram of the cam depicted in FIG. 3, which is situated at a stop position in a normal pressure application state.
Figure 10B:
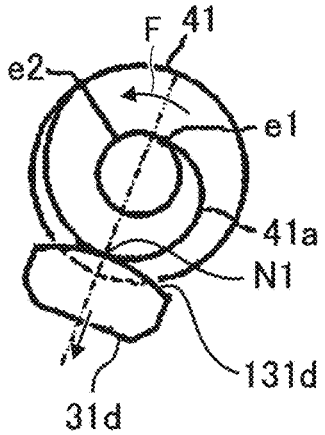
FIG. 10B is a diagram of the cam depicted in FIG. 10A, which is situated at a stop position in a particular pressure application state corresponding to a particular type of a sheet.
Figure 10C:
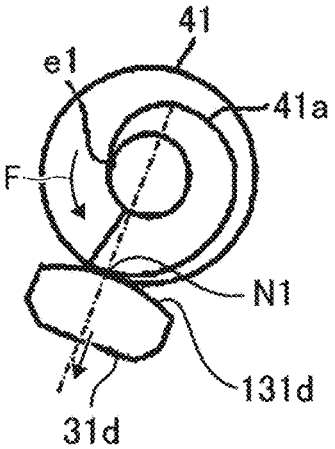
FIG. 10C is a diagram of the cam depicted in FIG. 10A, which is situated at a stop position in the pressure releasing state.

To address this circumstance of the comparative contact-separation device, according to this embodiment, as illustrated in FIGS. 10A, 10B, and 10C, the cam contact face 131*d* of the cam follower 31*d* is an arcuate, projecting curved face. A curvature of the projecting curved face is set between a decreased curvature (e.g., a smallest curvature) and an increased curvature (e.g., a greatest curvature) of the cam face 41*a* of the cam 41.

FIG. 10A illustrates the cam 41 situated at a stop position in the normal pressure application state in which the cam 41 causes the pressure roller 19 to press against the fixing roller 18 with the normal pressure. FIG. 10B illustrates the cam 41 situated at a stop position in a particular pressure application state in which the cam 41 causes the pressure roller 19 to press against the fixing roller 18 with pressure corresponding to a particular type of the sheet P. FIG. 10C illustrates the cam 41 situated at a stop position in the pressure releasing state in which the cam 41 causes the pressure roller 19 to release pressure with respect to the fixing roller 18.

According to this embodiment, as illustrated in FIG. 8, the cam face 41*a* has the smallest curvature at the increased distance point e2. Hence, a curvature of the cam contact face 131*d* is greater than the smallest curvature of the cam face 41*a* at the increased distance point e2. At each of the stop positions depicted in FIGS. 10A, 10B, and 10C, a curvature of the cam face 41*a* in a region from the target contact position N1 to the increased distance point e2 is greater than the curvature of the cam face 41*a* at the increased distance point e2. Hence, if the curvature of the cam contact face 131*d* is greater than the curvature of the cam face 41*a* at the increased distance point e2, the cam face 41*a* does not contact the cam contact face 131*d* in the region from the target contact position N1 to the increased distance point e2 at each of the stop positions. Accordingly, as illustrated in FIGS. 10A, 10B, and 10C, the cam face 41*a* contacts the cam contact face 131*d* at the target contact position N1 on the cam face 41*a* at each of the stop positions.

FIG. 10B illustrates the cam 41 situated at the single stop position in the particular pressure application state corresponding to the particular type of the sheet P. Alternatively, the cam 41 may stop at a plurality of stop positions selectively according to the type of the sheet P so that the cam 41 causes the pressure roller 19 to press against the fixing roller 18 with pressure that varies depending on the type of the sheet P.

The cam contact face 131*d* of the cam follower 31*d* is solely the arcuate, projecting curved face that projects toward the cam 41. Other faces of the cam follower 31*d* are planar. Accordingly, compared to a tubular cam follower that has an arcuate face entirely, for example, the cam follower 31*d* saves space. Additionally, as the cam follower 31*d* simply fits in a recess of the pressure lever 31, the cam follower 31*d* is attached to the pressure lever 31, attaining a simple construction and simple replacement of the cam follower 31*d*.

Figure 11:
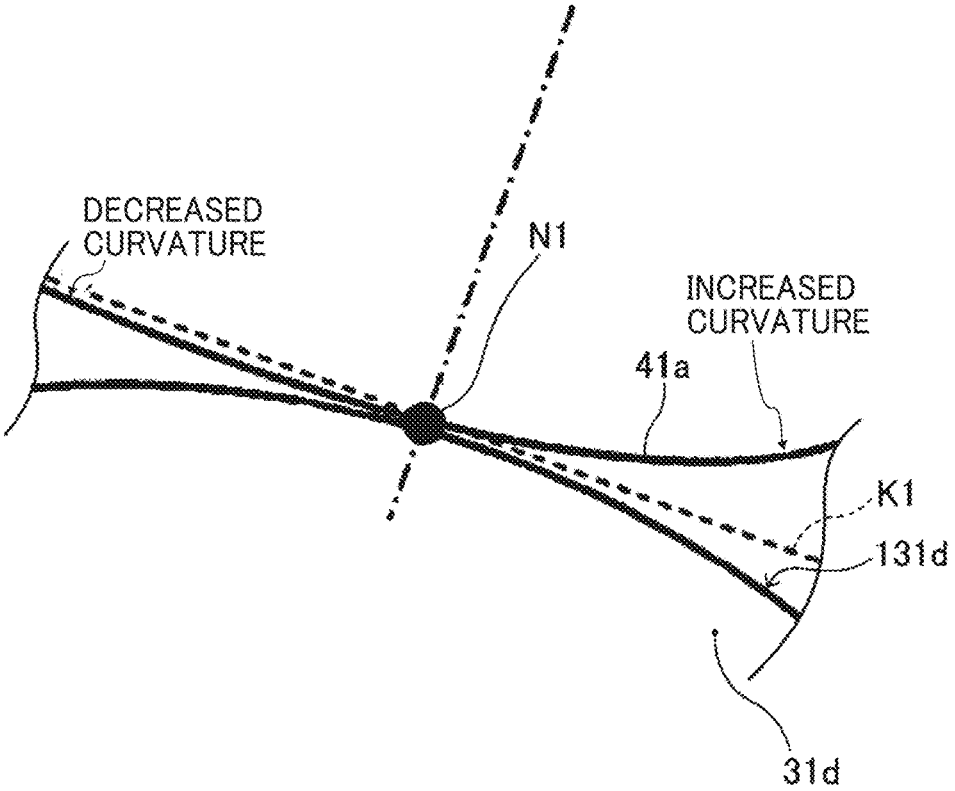
FIG. 11 is a diagram of a cam contact face of a cam follower and the cam face of the cam incorporated in the contact-separation device depicted in FIG. 5, illustrating the cam contact face contacting the cam face.

FIG. 11 is a diagram of the cam contact face 131*d* and the cam face 41*a* that contacts the cam contact face 131*d* according to this embodiment.

In FIG. 11, a fine broken line K1 indicates a hypothetical plane of the cam contact face 131*d*.

As illustrated in FIG. 11, the hypothetical plane of the cam contact face 131*d* indicated with the fine broken line K1 interferes with the cam face 41*a* in a left side in FIG. 11 on the left of the target contact position N1, which has the increased distance point e2 on the cam face 41*a*. However, according to this embodiment, since the cam contact face 131*d* is the projecting curved face that projects toward the cam face 41*a*, the cam face 41*a* at the target contact position N1 contacts a summit of the projecting curved face. Both sides of the cam contact face 131*d*, which are outboard from a contact portion of the cam contact face 131*d*, which contacts the cam face 41*a* at the target contact position N1, draw a trajectory that separates from the cam face 41*a*. Hence, according to this embodiment, the cam contact face 131*d* does not interfere with the cam face 41*a* in the left side in FIG. 11 on the left of the target contact position N1, which has the increased distance point e2 on the cam face 41*a*.

The curvature of the cam contact face 131*d* is greater than the smallest curvature of the cam face 41*a*. Accordingly, even if the cam 41 stops at any rotation position, the cam face 41*a* does not contact the cam contact face 131*d* in the left side in FIG. 11 on the left of the target contact position N1, which has the increased distance point e2 on the cam face 41*a*.

As described above, according to this embodiment, the curvature of the cam contact face 131*d* is greater than the smallest curvature of the cam face 41*a*. Accordingly, the cam face 41*a* contacts the cam contact face 131*d* at the target contact position N1 on the cam face 41*a*, causing the cam 41 to press the cam follower 31*d* with the target pressing amount. Consequently, the pressure lever 31 presses the pressure roller 19 with the target pressing amount, causing the pressure roller 19 to press against the fixing roller 18 at the fixing nip N with the target pressure. Thus, the fixing device 12 attains a proper fixing property of fixing the toner image on the sheet P properly.

Figure 12A:
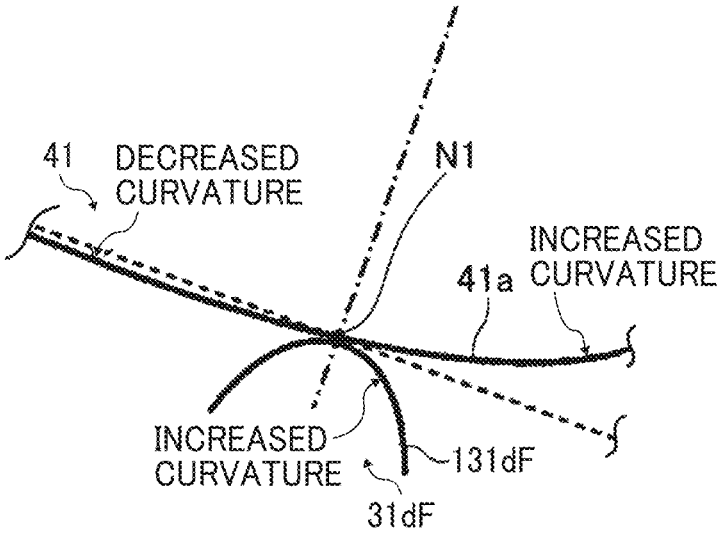
FIG. 12A is a diagram of a comparative cam contact face having a curvature greater than an increased curvature of the cam face, illustrating failure of the comparative cam contact face.
Figure 12B:
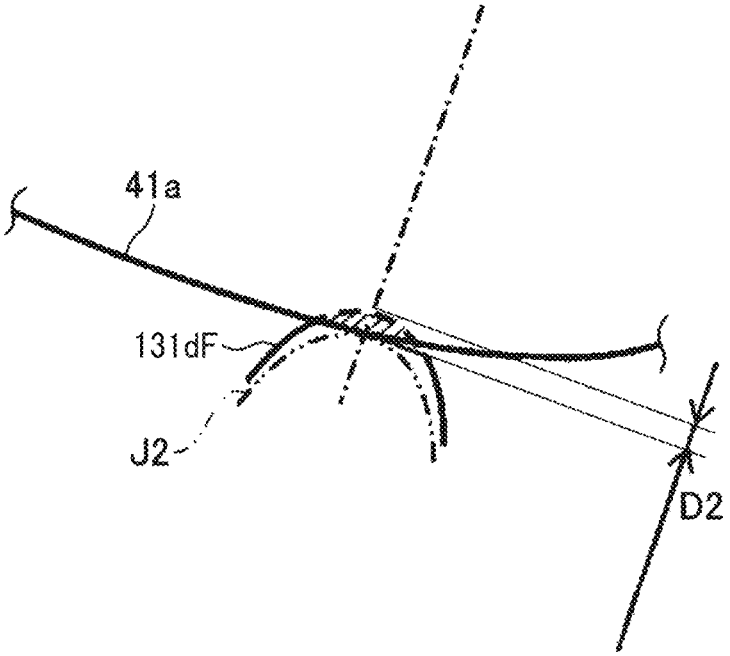
FIG. 12B is another diagram of the comparative cam contact face depicted in FIG. 12A, illustrating failure of the comparative cam contact face.

Referring to FIGS. 12A and 12B, a description is provided of failure that may occur if a curvature of a cam contact face 131*d* F is greater than the greatest curvature of the cam face 41*a*.

As illustrated in FIG. 12A, even if the curvature of the cam contact face 131*d* F is greater than the greatest curvature of the cam face 41*a*, the cam face 41*a* contacts the cam contact face 131*d* F at the target contact position N1 on the cam face 41*a*.

As the cam 41 rotates, the cam face 41*a* slides over the cam contact face 131*d* F, causing abrasion of the cam contact face 131*d* F. For example, like the cam follower 31*d* according to the embodiments of the present disclosure, a cam follower 31*d* F is made of resin that facilitates sliding of the cam 41 over the cam follower 31*d* F. Hence, the cam contact face 131*d* F is subject to abrasion as the cam face

41*a* slides over the cam contact face 131*d* F. As illustrated in FIG. 12B, if the curvature of the cam contact face 131*d* F is excessively great, as the cam contact face 131*d* F suffers from abrasion, a length of the cam contact face 131*d* F in a height direction (e.g., a projecting direction) thereof may change substantially as indicated with an alternate long and two short dashes line J2. Accordingly, abrasion of the cam contact face 131*d* F increases deviation (e.g., decrease) of the pressing amount of the cam 41 from the target pressing amount by an amount corresponding to a length D2. Consequently, the cam 41 may not retain the pressure roller 19 to press against the fixing roller 18 at the fixing nip N with the target pressure over time.

In addition to the above-described deviation of the pressing amount of the cam 41 due to abrasion of the cam contact face 131*d* F, if the curvature of the cam contact face 131*d* F is greater than the greatest curvature of the cam face 41*a*, an error in the length of the cam contact face 131*d* F in the height direction thereof may increase due to variation of parts. As a result, an accuracy in the pressing amount is subject to instability disadvantageously.

Figure 13:
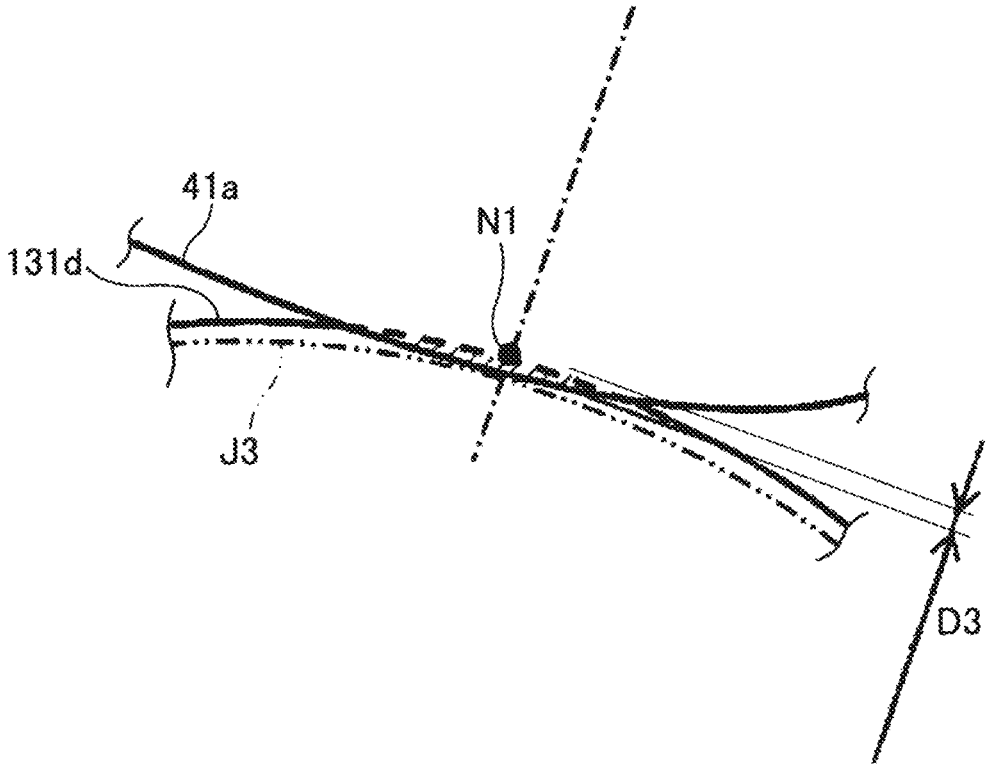
FIG. 13 is a diagram of the cam contact face depicted in FIG. 11, illustrating abrasion of the cam contact face.

FIG. 13 is a diagram of the cam face 41*a* and the cam contact face 131*d* according to this embodiment, illustrating abrasion of the cam contact face 131*d*.

As illustrated in FIG. 13, the curvature of the cam contact face 131*d* is smaller than the greatest curvature of the cam face 41*a* (e.g., the curvature of the cam face 41*a* at the decreased distance point e1 according to this embodiment). Accordingly, when the cam contact face 131*d* depicted in FIG. 13 suffers from abrasion, a length of the cam contact face 131*d* depicted in FIG. 13 in a height direction thereof, which has a volume identical to a volume of the cam contact face 131*d* F depicted in FIG. 12B, decreases less than the cam contact face 131*d* F depicted in FIG. 12B.

The curvature of the cam contact face 131*d* is smaller than the greatest curvature of the cam face 41*a* (e.g., the curvature of the cam face 41*a* at the decreased distance point e1 according to this embodiment). Hence, compared to the cam contact face 131*d* F depicted in FIGS. 12A and 12B, the cam contact face 131*d* depicted in FIG. 13 suffers from an increased abrasion width in a horizontal direction in FIG. 13. However, the cam contact face 131*d* suffers from abrasion along the cam face 41*a* as indicated with an alternate long and two short dashes line J3 in FIG. 13. A part of the cam contact face 131*d*, which suffers from abrasion, produces a recessed abrasion face (e.g., a recess). For example, when the cam face 41*a* contacts the cam contact face 131*d* with increased pressure at a part of the cam face 41*a*, which is in proximity to the increased distance point e2 and has the decreased curvature, abrasion of the cam contact face 131*d* accelerates. Hence, the recessed abrasion face of the cam contact face 131*d* suffers from abrasion in accordance with the curvature of the part of the cam face 41*a*, which is in proximity to the increased distance point e2. Accordingly, when the cam 41 stops, as illustrated in FIG. 13, the cam face 41*a* contacts and engages the recessed abrasion face of the cam contact face 131*d*. Hence, abrasion of the cam contact face 131*d* does not deviate a contact position where the cam face 41*a* contacts the cam contact face 131*d*, when the cam 41 stops, from the target contact position N1 leftward in FIG. 13 to a left side on the left of the target contact position N1, which is provided with the increased distance point e2. Accordingly, an amount of abrasion of the cam contact face 131*d* in the height direction thereof, which corresponds to a length D3, affects an amount of deviation in the pressing amount of the cam 41 from the target pressing amount.

As illustrated in FIG. 13, the curvature of the cam contact face 131*d* is smaller than the greatest curvature of the cam face 41*a* (e.g., the curvature of the cam face 41*a* at the decreased distance point e1 according to this embodiment). Decrease in the length of the cam contact face 131*d* in the height direction thereof caused by abrasion is suppressed, thus decreasing the amount of deviation in the pressing amount of the cam 41 from the target pressing amount, which might be caused by abrasion of the cam contact face 131*d*. Accordingly, the cam contact face 131*d* suppresses decrease in pressure applied at the fixing nip N over time, which might be caused by abrasion of the cam contact face 131*d*.

Additionally, the curvature of the cam contact face 131*d* is smaller than the greatest curvature of the cam face 41*a*. Accordingly, compared to a configuration in which the curvature of the cam contact face 131*d* is greater than the greatest curvature of the cam face 41*a*, the cam contact face 131*d* is immune from change in the length of the cam contact face 131*d* in the height direction thereof (e.g., a projecting direction of the cam contact face 131*d*) due to variation of parts. Consequently, the cam contact face 131*d* also advantageously suppresses change in the pressing amount of the cam 41 due to variation of parts.

Figure 14:
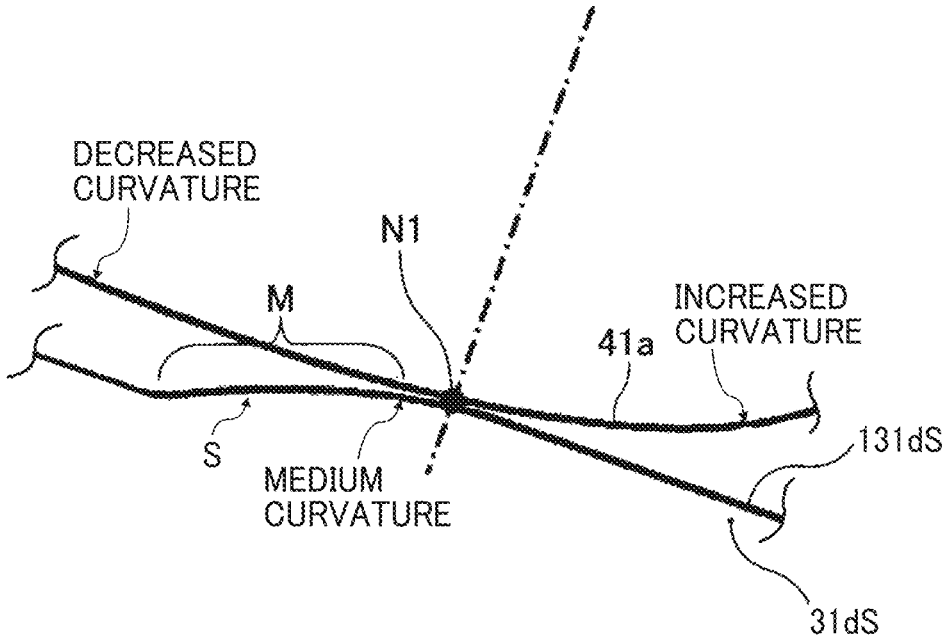
FIG. 14 is a diagram of a cam contact face according to a modification example, which is installable in the fixing device depicted in FIG. 2.

FIG. 14 is a diagram of a cam contact face 131*d*S of a cam follower 31*d*S as a modification example of the cam contact face 131*d* depicted in FIG. 13.

The cam contact face 131*d*S includes a step S that is lowered by one step from a contact portion of the cam contact face 131*d*S, which contacts the target contact position N1 on the cam face 41*a*. The step S is disposed opposite a left side in FIG. 14 on the left of the target contact position N1, which is provided with the increased distance point e2 on the cam face 41*a*. The step S includes a step face M defining a projecting curved face that projects toward the cam face 41*a* and has a medium curvature between the greatest curvature and the smallest curvature of the cam face 41*a*.

As described above, the cam contact face 131*d*S includes the step S that is lowered by one step from the contact portion of the cam contact face 131*d*S, which contacts the cam face 41*a* at the target contact position N1 thereon. The step S is disposed opposite the left side of the cam face 41*a* in FIG. 14, which is provided with the increased distance point e2. Hence, the cam contact face 131*d*S separates from the left side in FIG. 14 of the cam face 41*a* on the left of the target contact position N1, which is provided with the increased distance point e2. Accordingly, the cam contact face 131*d*S further prevents the cam face 41*a* in the left side in FIG. 14 on the left of the target contact position N1 from contacting the cam contact face 131*d*S. Consequently, the cam face 41*a* contacts the cam contact face 131*d*S at the target contact position N1 on the cam face 41*a* more precisely.

As described above with reference to FIG. 2, the supported end 31*a* of the pressure lever 31, that is, one end being opposite to another end mounting the cam follower 31*d*, pivots about the support shaft 33. Hence, as the pressure lever 31 pivots, the cam follower 31*d* mounted on the pressure lever 31 changes posture. Accordingly, the cam contact face 131*d* also contacts the cam face 41*a* variably.

Figure 15:
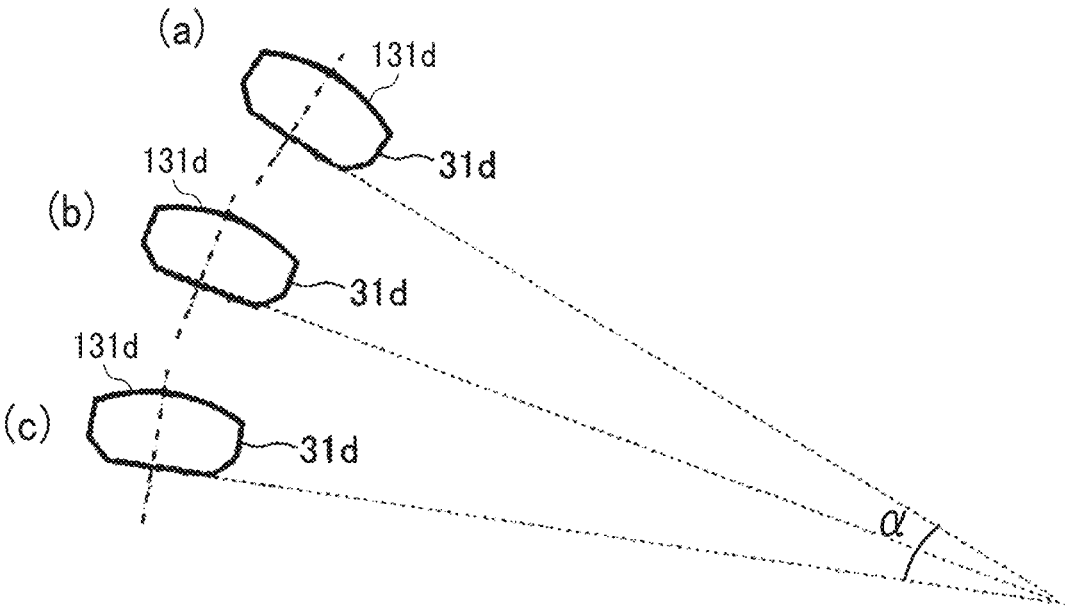
FIG. 15 is a diagram of the cam follower depicted in FIG. 11, illustrating posture of the cam follower, which changes as a pressure lever incorporated in the fixing device depicted in FIG. 2 pivots.

FIG. 15 is a diagram of the cam follower 31*d*, illustrating the posture of the cam follower 31*d* that changes as the pressure lever 31 pivots.

In order to indicate the posture of the cam follower 31*d* that changes as the pressure lever 31 pivots clearly, FIG. 15 illustrates the cam follower 31*d* by distinguishing the posture of the cam follower 31*d* that changes.

A part (a) in FIG. 15 illustrates a posture of the cam follower 31*d* in the normal pressure application state in which the cam 41 causes the pressure roller 19 to press against the fixing roller 18 with the normal pressure. A part (b) in FIG. 15 illustrates another posture of the cam follower 31*d* in the particular pressure application state in which the cam 41 causes the pressure roller 19 to press against the fixing roller 18 with pressure corresponding to the particular type of the sheet P. A part (c) in FIG. 15 illustrates yet another posture of the cam follower 31*d* in the pressure releasing state in which the cam 41 causes the pressure roller 19 to release pressure with respect to the fixing roller 18.

As illustrated in FIG. 15, compared to the pressure releasing state, the cam follower 31*d* inclines in the normal pressure application state. Accordingly, as illustrated in the part (a) in FIG. 15, in the normal pressure application state, a left portion of the cam contact face 131*d* in FIG. 15 is situated higher than a right portion of the cam contact face 131*d*. Thus, the left portion of the cam contact face 131*d* in FIG. 15 is disposed closer to the cam 41 than the right portion of the cam contact face 131*d*. As illustrated in the part (c) in FIG. 15, the left portion of the cam contact face 131*d* in FIG. 15 separates farthest from the cam 41 in the pressure releasing state. Conversely, in the pressure releasing state, the right portion of the cam contact face 131*d* in FIG. 15 is situated closer to the cam 41. As illustrated in the part (a) in FIG. 15, in the normal pressure application state, the right portion of the cam contact face 131*d* in FIG. 15 separates farthest from the cam 41.

Figure 16A:
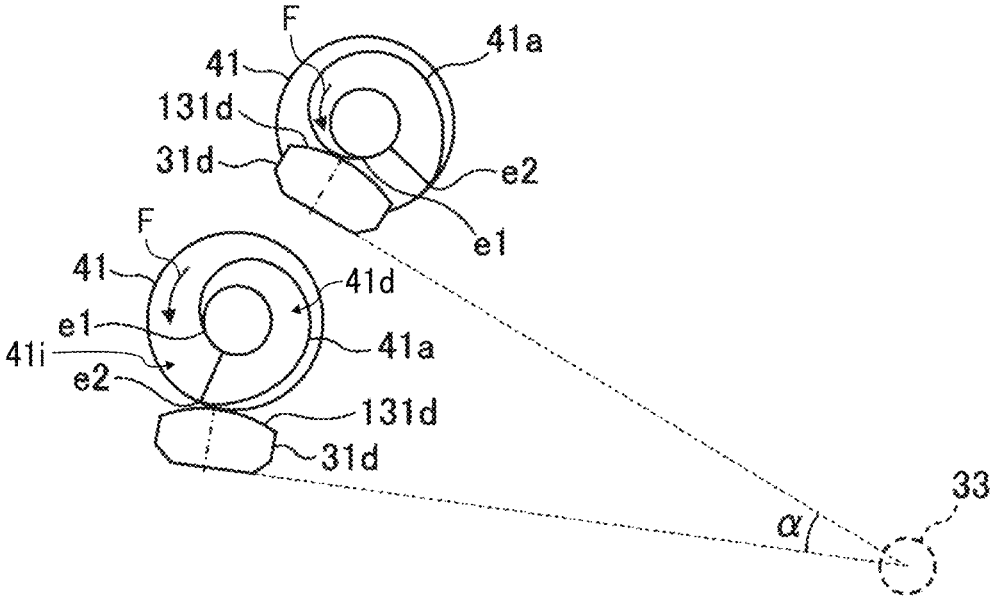
FIG. 16A is a diagram of the cam face of the cam depicted in FIG. 11, illustrating a relation between the cam face and a support shaft supporting the pressure lever.
Figure 16B:
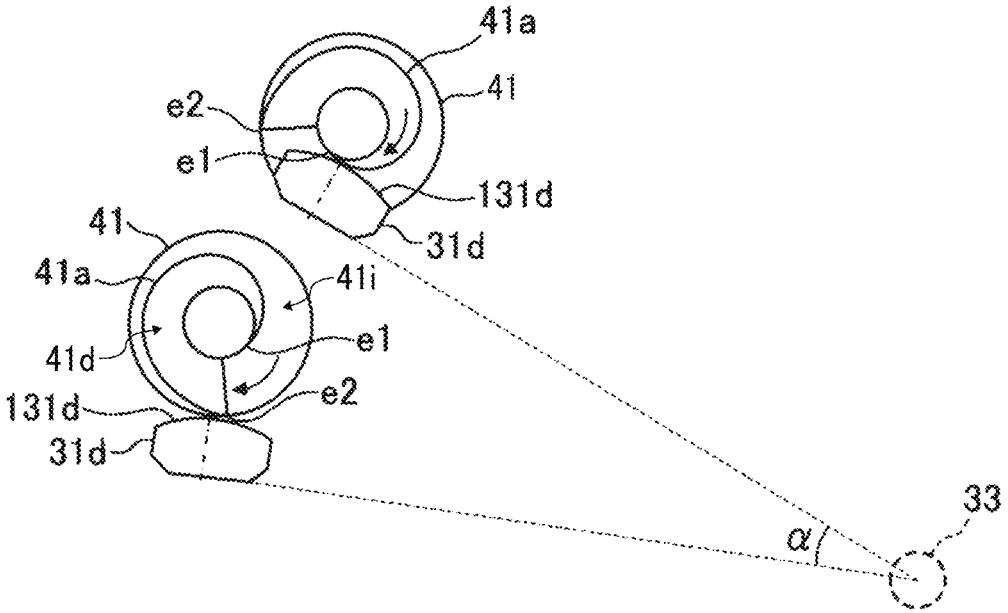
FIG. 16B is a diagram of the cam face of the cam depicted in FIG. 16A, illustrating another relation between the cam face and the support shaft.

FIGS. 16A and 16B illustrate a relation between the cam face 41*a* of the cam 41 and the support shaft 33 serving as a fulcrum of the pressure lever 31 that pivots.

FIG. 16A illustrates the cam 41 situated such that a distance decreasing portion 41*d* (e.g., a curvature increasing portion) of the cam 41 with respect to a contact position where the cam 41 contacts the cam follower 31*d* is disposed closer to or disposed opposite the support shaft 33 supporting the pressure lever 31. Conversely, FIG. 16B illustrates the cam 41 situated such that a distance increasing portion 41*i* (e.g., a curvature decreasing portion) of the cam 41 with respect to the contact position where the cam 41 contacts the cam follower 31*d* is disposed closer to or disposed opposite the support shaft 33 supporting the pressure lever 31.

In order to indicate the relation between the cam face 41*a* and the support shaft 33 clearly, FIGS. 16A and 16B also illustrate a pivot angle α of the pressure lever 31, which is greater than an actual pivot angle of the pressure lever 31, and the cam follower 31*d* by distinguishing the posture of the cam follower 31*d* that changes.

As described above, the cam face 41*a* has the greatest curvature at the decreased distance point e1. The curvature of the cam face 41*a* decreases from the decreased distance point e1 to the increased distance point e2. The cam face 41*a* has the smallest curvature at the increased distance point e2. Hence, at a position on the cam face 41*a*, which is in proximity to the decreased distance point e1 on the cam face 41*a*, as the cam face 41*a* situated outboard from the contact position where the cam face 41*a* contacts the cam contact face 131*d*, that is, on the left of the contact position in FIG. 16B, is situated more outboard from the contact position, the cam face 41*a* separates from the cam contact face 131*d* sharply. At a position on the cam face 41*a*, which is in proximity to the increased distance point e2 on the cam face 41*a*, the cam face 41*a* situated outboard from the contact position where the cam face 41*a* contacts the cam contact face 131*d*, that is, on the left of the contact position in FIG. 16B, does not substantially change the distance from the cam contact face 131*d* to the cam face 41*a* between a position in proximity to the contact position and a position distanced from the contact position. Thus, the cam face 41*a* situated outboard from the contact position is in proximity to the cam contact face 131*d*.

With an arrangement of the cam face 41*a* with respect to the support shaft 33 illustrated in FIG. 16A, the cam 41 rotates counterclockwise in FIG. 16A in the rotation direction F from a state in which an outboard portion of the cam follower 31*d*, which is situated outboard from and on the left of the contact position where the cam face 41*a* contacts the cam contact face 131*d*, is closest to the cam face 41*a*. The outboard portion of the cam follower 31*d* is opposite to an inboard portion of the cam follower 31*d*, which is closer to the support shaft 33 than the outboard portion of the cam follower 31*d* is. As the cam 41 rotates counterclockwise in FIG. 16A in the rotation direction F, the cam 41 presses against the cam follower 31*d* with increasing pressure. Accordingly, an outboard portion of the cam contact face 131*d*, which is disposed outboard from the contact position where the cam face 41*a* contacts the cam contact face 131*d*, separates from the cam face 41*a* gradually. Hence, with the arrangement of the cam face 41*a* with respect to the support shaft 33 illustrated in FIG. 16A, with a relation in which an outboard portion of the cam face 41*a*, which is disposed outboard from the contact position where the cam face 41*a* contacts the cam contact face 131*d*, separates from the cam contact face 131*d* sharply, the cam contact face 131*d* is closest to the cam face 41*a*. As the outboard portion of the cam face 41*a*, which is disposed outboard from the contact position where the cam face 41*a* contacts the cam contact face 131*d*, moves closer to the cam contact face 131*d*, the cam contact face 131*d* separates from the cam face 41*a*. Hence, with the arrangement of the cam face 41*a* with respect to the support shaft 33 depicted in FIG. 16A, the outboard portion of the cam face 41*a*, which is disposed outboard from the contact position where the cam face 41*a* contacts the cam contact face 131*d*, does not come into contact with the cam contact face 131*d* easily. As a result, the cam face 41*a* contacts the cam contact face 131*d* at the target contact position N1 on the cam face 41*a* properly.

With an arrangement of the cam face 41*a* with respect to the support shaft 33 illustrated in FIG. 16B, a right side in FIG. 16B of the cam face 41*a* on the right of the contact position where the cam face 41*a* contacts the cam follower 31*d* (e.g., an inboard portion of the cam face 41*a*, which is closer to the support shaft 33) has a decreased curvature. The cam face 41*a* is close to the cam contact face 131*d* at a position in proximity to the increased distance point e2 on the cam face 41*a*.

The inboard portion of the cam follower 31*d* (e.g., a right side in FIG. 16B of the cam follower 31*d* on the right of the contact position where the cam face 41*a* contacts the cam contact face 131*d*) gradually moves closer to the cam face 41*a* from a position where the cam contact face 131*d* separates farthest from the cam face 41*a* as the cam 41 presses against the cam follower 31*d*. The inboard portion of the cam follower 31*d* is closest to the cam face 41*a* at a position in proximity to the increased distance point e2 on the cam face 41*a*. Accordingly, with the arrangement of the cam face 41*a* with respect to the support shaft 33 illustrated in FIG. 16B, in the pressure releasing state in which the position in proximity to the increased distance point e2 on the cam face 41*a* is the target contact position N1, the inboard portion of the cam face 41*a* may contact the inboard portion of the cam contact face 131*d*. Hence, the cam face 41*a* may not contact the cam contact face 131*d* at the target contact position N1 on the cam face 41*a*. To address this circumstance, as illustrated in FIG. 16A, the cam 41 is preferably arranged with respect to the support shaft 33 serving as the fulcrum of the pressure lever 31 such that the support shaft 33 is disposed opposite the cam face 41*a* that is oriented in the direction in which the distance from the center of rotation of the cam 41 to the cam face 41*a* gradually decreases from the contact position where the cam face 41*a* contacts the cam contact face 131*d* in the rotation direction F of the cam 41. For example, the cam 41 includes the distance decreasing portion 41*d* in which the distance from the center of rotation of the cam 41 to the cam face 41*a* decreases gradually from the contact position where the cam face 41*a* contacts the cam contact face 131*d*.

Figure 17:
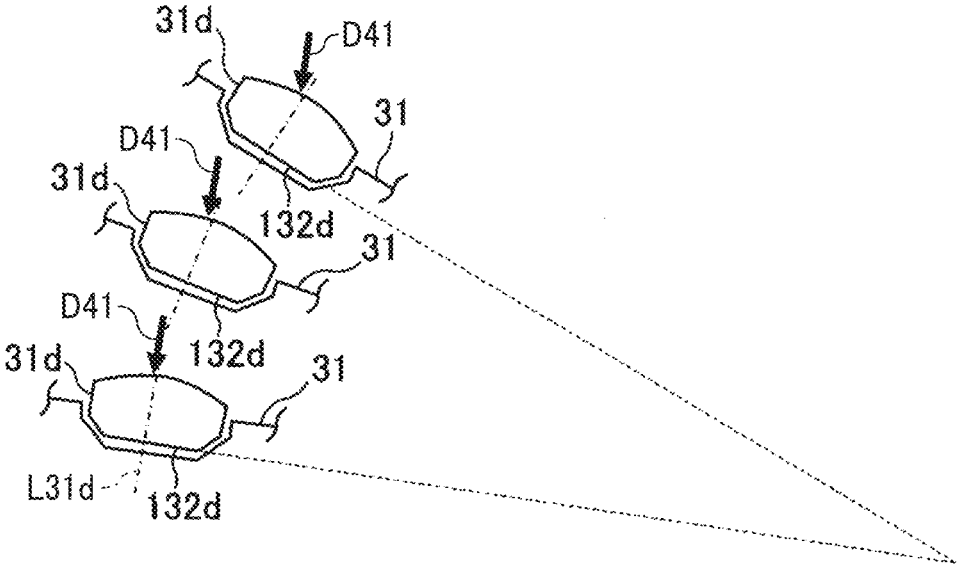
FIG. 17 is a diagram of the cam follower depicted in FIG. 11, schematically illustrating postures of the cam follower and a pressing direction in which the cam exerts pressure to the cam follower.

FIG. 17 is a diagram of the cam follower 31*d* and the pressure lever 31, schematically illustrating postures of the cam follower 31*d* and a pressing direction D41 in which the cam 41 exerts a force (e.g., pressure) to the cam follower 31*d*. As illustrated in FIG. 17, as the pressure lever 31 pivots, the posture of the cam follower 31*d* changes, thus changing a positional relation between the cam follower 31*d* and the cam face 41*a*. The pressing direction D41 depicted in FIG. 17 in which the cam 41 exerts the force (e.g., pressure) to the cam follower 31*d* is not constant.

FIG. 17 illustrates a center line L31*d* of the cam follower 31*d* with an alternate long and short dash line. The cam follower 31*d* includes a bottom face 132*d* serving as a presser contact face that contacts the pressure lever 31. The center line L31*d* of the cam follower 31*d* is a perpendicular line that is perpendicular to the bottom face 132*d* and extends from a center of the bottom face 132*d* in a width direction thereof.

Figure 18:
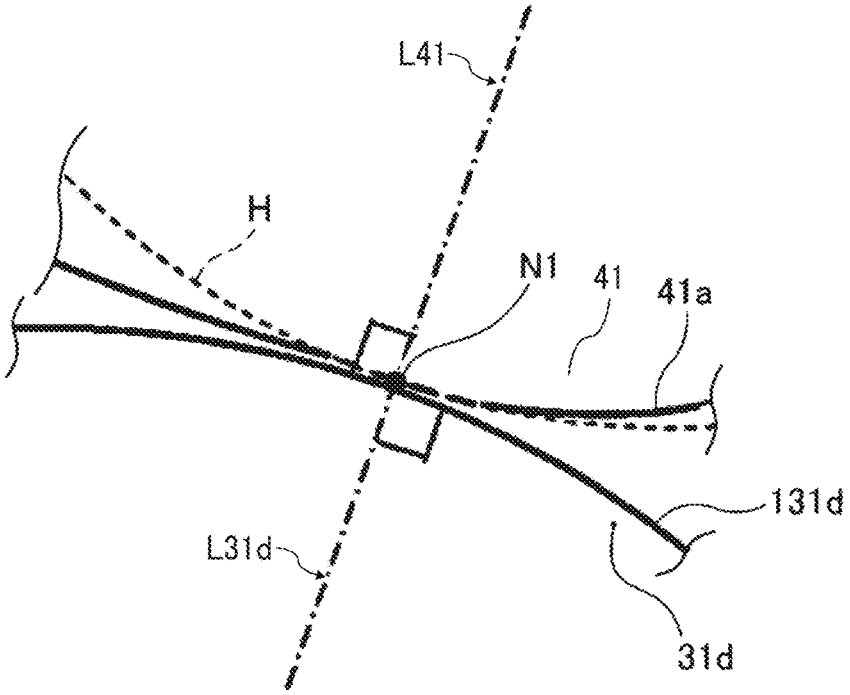
FIG. 18 is a diagram of the cam follower and the cam depicted in FIG. 11, illustrating a preferable positional relation between the cam follower and the cam.

FIG. 18 is a diagram of the cam follower 31*d* and the cam 41, illustrating a preferable positional relation between the cam follower 31*d* and the cam 41.

As illustrated in FIG. 18, a center line L41 of the cam 41 preferably overlaps the center line L31*d* of the cam follower 31*d*. Additionally, each of the center lines L41 and L31*d* is preferably perpendicular to a tangent to the contact position where the cam 41 contacts the cam follower 31*d*. With the positional relation described above, the cam follower 31*d* receives the force (e.g., pressure) from the cam 41 in a direction parallel to the center line L31*d*. Hence, the cam follower 31*d* does not receive a local load in a width direction of the cam follower 31*d* (e.g., a horizontal direction in FIG. 18).

However, as described above with reference to FIG. 17, since the posture of the cam follower 31*d* changes the positional relation between the cam follower 31*d* and the cam 41, the cam follower 31*d* may not retain the preferable positional relation depicted in FIG. 18 with various postures of the cam follower 31*d*. To address this circumstance, in the pressure releasing state in which the cam follower 31*d* receives greatest pressure from the cam 41, that is, when the position in proximity to the increased distance point e2 on the cam face 41*a* is the target contact position N1, the cam 41 and the cam follower 31*d* are preferably arranged to attain the positional relation depicted in FIG. 18.

A lowermost part in FIG. 17 illustrates the cam follower 31*d* in the pressure releasing state that achieves the positional relation depicted in FIG. 18. As illustrated in FIG. 17 with the pressing direction D41, in the pressure releasing state, the cam follower 31*d* receives the force (e.g., pressure) from the cam 41 in a direction parallel to the center line L31*d* of the cam follower 31*d* indicated with the alternate long and short dash line in FIG. 17. Conversely, when the cam follower 31*d* has the postures as illustrated in an uppermost part and a middle part in FIG. 17, the cam follower 31*d* receives the force (e.g., pressure) from the cam 41 in directions not parallel to the center line L31*d* of the cam follower 31*d*. Hence, the cam follower 31*d* receives the force (e.g., pressure) from the cam 41 in a proximal side (e.g., the inboard portion) of the cam follower 31*d*, which is disposed closer to the support shaft 33 supporting the pressure lever 31. Thus, the cam follower 31*d* is exerted with an uneven force (e.g., uneven pressure). When the cam follower 31*d* has the postures as illustrated in the uppermost part and the middle part in FIG. 17, compared to the pressure releasing state illustrated in the lowermost part in FIG. 17, the cam follower 31*d* receives a decreased force from the cam 41 (e.g., a decreased reactive force from the pressure spring 32). Accordingly, compared to the pressure releasing state, when the cam follower 31*d* is exerted with the uneven force, the cam follower 31*d* suffers from less failure. Hence, in the pressure releasing state, that is, when the position in proximity to the increased distance point e2 on the cam face 41*a* is the target contact position N1, the cam 41 and the cam follower 31*d* are preferably arranged to attain the positional relation depicted in FIG. 18.

Among the plurality of stop positions of the cam 41, the fixing device 12 may employ an arrangement of the cam 41 and the cam follower 31*d*, which attains the positional relation depicted in FIG. 18, with the posture of the cam follower 31*d* when the cam 41 is situated at a stop position which is retained for a longest time during usage of the fixing device 12.

Figure 19:
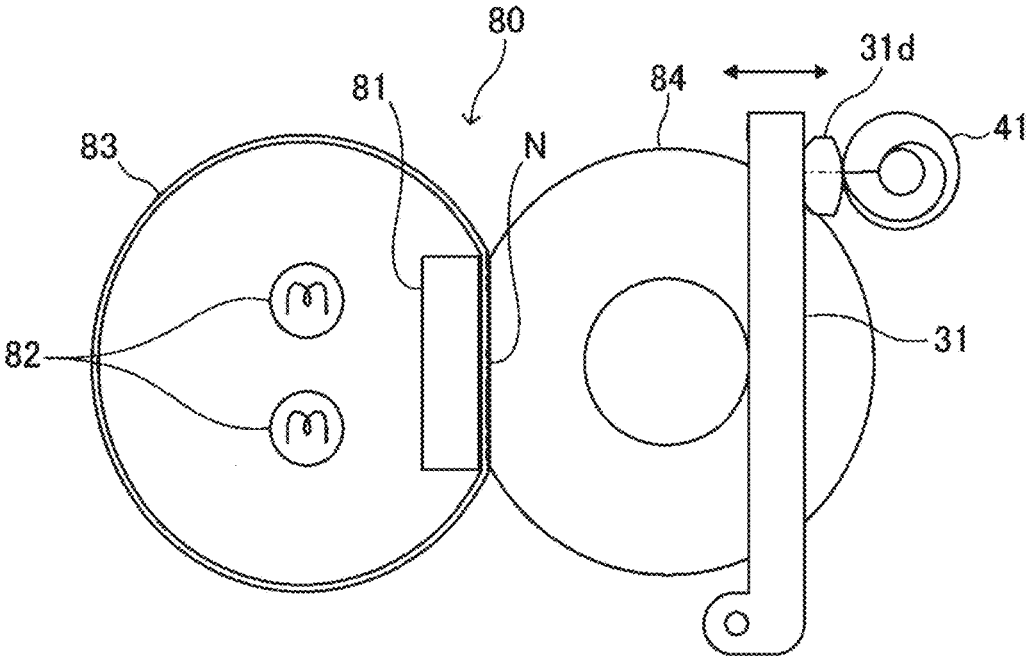
FIG. 19 is a schematic cross-sectional view of a fixing device as a first variation of the fixing device depicted in FIG. 2.

The embodiments of the present disclosure are also applicable to fixing devices other than the fixing device 12 incorporating a pair of rollers (e.g., the fixing roller 18 and the pressure roller 19) as described above. For example, as illustrated in FIG. 19, the embodiments of the present disclosure are also applicable to a fixing device 80 incorporating an endless fixing belt 83 instead of the fixing roller 18. The fixing device 80 includes heaters 82 and a nip formation pad 81 disposed opposite an inner circumferential surface of the fixing belt 83. A pressure roller 84 presses against the nip formation pad 81 via the fixing belt 83 to form the fixing nip N between the fixing belt 83 and the pressure roller 84.

Figure 20:
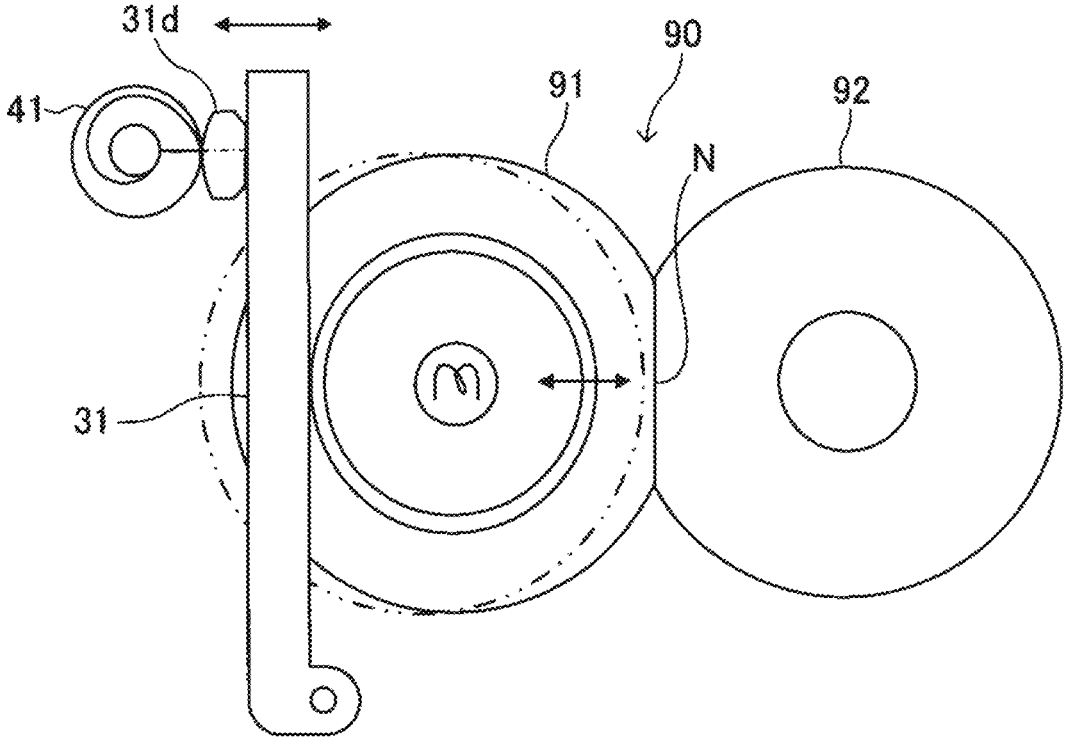
FIG. 20 is a schematic cross-sectional view of a fixing device as a second variation of the fixing device depicted in FIG. 2.

According to the embodiments described above, the pressure roller 19 comes into contact with and separates from the fixing roller 18. Alternatively, as illustrated in FIG. 20, a fixing device 90 may include a fixing roller 91 that comes into contact with and separates from an opposed roller 92 disposed opposite the fixing roller 91. In the fixing device 90, the fixing roller 91 serves as a contact-separation member. The opposed roller 92 serves as a contacted member.

The contact-separation device 40 according to the embodiments described above is installed in the fixing device 12. Alternatively, the contact-separation device 40 may be applied to a transfer device and the like that transfer an image onto a recording medium such as a sheet.

The embodiments described above are examples and achieve advantages peculiar to aspects below, respectively.

A description is provided of a first aspect of the technology of the present disclosure.

As illustrated in FIG. 2, a contact-separation device (e.g., the contact-separation device 40) includes a biasing member (e.g., the pressure spring 32), a presser (e.g., the pressure lever 31), a cam (e.g., the cam 41), and a cam follower (e.g., the cam followers 31*d* and 31*d*S). The biasing member generates a biasing force that biases the presser to press a contact-separation member (e.g., the pressure roller 19) against a contacted member (e.g., the fixing roller 18) in a pressing direction (e.g., the contact-separation direction D) such that the contact-separation member separably contacts the contacted member. The cam is rotatable and presses the presser in an opposite direction (e.g., the contact-separation direction D) opposite to the pressing direction. The cam follower is mounted on the presser and includes a cam contact face (e.g., the cam contact faces 131*d* and 131*d*S) that contacts the cam. The cam contact face defines a projecting curved face that is curved to project toward the cam. The cam includes a cam face (e.g., the cam face 41*a*) that contacts the cam contact face of the cam follower. The cam contact face has a curvature that is smaller than an increased curvature (e.g., the greatest curvature) of the cam face and is greater than a decreased curvature (e.g., the smallest curvature) of the cam face.

As described above with reference to FIGS. 9A, 9B, and 9C, the target contact position N1 on the cam face 41*a* defines a decreased curvature portion of the cam face 41*a* in the rotation direction of the cam 41. The curvature of the decreased curvature portion of the cam face 41*a* is smaller than the curvature of the cam face 41*a* at the target contact position N1. The cam face 41*a* comes closer to and comes into contact with the cam contact face 131*d*C in the decreased curvature portion of the cam face 41*a* than the target contact position N1 on the cam face 41*a*. Hence, if the cam contact face 131*d*C is planar, the decreased curvature portion of the cam face 41*a*, which has the curvature smaller than the curvature of the cam face 41*a* at the target contact position N1, may contact the cam contact face 131*d*C. Accordingly, the cam 41 may not press the pressure lever 31 serving as the presser with the target pressing amount, displacing the pressure roller 19 serving as the contact-separation member from the target position.

To address this circumstance, in the first aspect, the cam contact face is the projecting curved face that causes the curvature of the cam contact face to be greater than the decreased curvature (e.g., the smallest curvature) of the cam face. Accordingly, as described above with reference to FIG. 11, the cam face 41*a* contacts the cam contact face 131*d* at the target contact position N1 on the cam face 41*a*. Consequently, the cam 41 causes the cam follower 31*d* to press the pressure lever 31 serving as the presser with the target pressing amount, moving the pressure roller 19 serving as the contact-separation member to the target position.

Additionally, the curvature of the cam contact face is smaller than the increased curvature of the cam face of the cam. Accordingly, compared to a configuration in which the curvature of the cam contact face is not smaller than the increased curvature of the cam face, the cam contact face suppresses decrease in a height of the cam contact face due to abrasion. Consequently, the cam contact face moves the contact-separation member to the target position over time.

A description is provided of a second aspect of the technology of the present disclosure.

Based on the first aspect, the cam follower (e.g., the cam follower 31*d*) is mounted on the presser (e.g., the pressure lever 31) and is made of resin. The cam follower includes the cam contact face (e.g., the cam contact face 131*d*).

Accordingly, as described above in the embodiments, the cam follower suppresses sliding friction between the cam and the cam follower, facilitating smooth rotation of the cam. Additionally, the cam follower is manufactured at reduced costs.

A description is provided of a third aspect of the technology of the present disclosure.

Based on the second aspect, the cam contact face (e.g., the cam contact face 131*d*) as a part of the cam follower (e.g., the cam follower 31*d*) defines the projecting curved face.

Accordingly, as described above in the embodiments, compared to the tubular cam follower that has the arcuate face entirely, the cam follower 31*d* saves space. Additionally, as the cam follower 31*d* simply fits in the recess of the pressure lever 31, the cam follower 31*d* is attached to the pressure lever 31, attaining the simple construction and simple replacement of the cam follower 31*d*.

A description is provided of a fourth aspect of the technology of the present disclosure.

Based on any one of the first to third aspects, the cam (e.g., the cam 41) selectively stops at a plurality of stop positions.

Accordingly, at each of the stop positions, the cam moves the contact-separation member (e.g., the pressure roller 19) to the target position.

A description is provided of a fifth aspect of the technology of the present disclosure.

Based on the fourth aspect, among the plurality of stop positions of the cam (e.g., the cam 41), when the cam stops at a stop position where the cam presses the presser (e.g., the pressure lever 31) with an increased pressing amount (e.g., a greatest pressing amount), when seen in an axial direction of the cam, as illustrated in FIG. 18, a hypothetical line (e.g., the center line L41) that passes through a center of rotation of the cam and a contact position (e.g., the target contact position N1) where the cam face (e.g., the cam face 41*a*) contacts the cam contact face (e.g., the cam contact face 131*d*) is perpendicular to a presser contact face (e.g., the bottom face 132*d*) of the cam follower (e.g., the cam follower 31*d*) depicted in FIG. 17. The presser contact face contacts the presser.

Accordingly, as described above with reference to FIGS. 17 and 18, at the stop position of the cam where the cam contact face receives an increased force (e.g., a greatest force) from the cam, the cam follower does not receive a local load and therefore is immune from damaging and deformation.

A description is provided of a sixth aspect of the technology of the present disclosure.

Based on the fourth aspect, among the plurality of stop positions of the cam (e.g., the cam 41), when the cam stops at a stop position where the cam stops with an increased frequency (e.g., most frequently), when seen in the axial direction of the cam, as illustrated in FIG. 18, the hypothetical line (e.g., the center line L41) that passes through the center of rotation of the cam and the contact position (e.g., the target contact position N1) where the cam face (e.g., the cam face 41*a*) contacts the cam contact face (e.g., the cam contact face 131*d*) is perpendicular to the presser contact face (e.g., the bottom face 132*d*) of the cam follower (e.g., the cam follower 31*d*). The presser contact face contacts the presser (e.g., the pressure lever 31).

Accordingly, as described above in the embodiments, at the stop position of the cam where the cam stops with the increased frequency (e.g., most frequently), the cam follower does not receive the local load and therefore is immune from damaging and deformation.

A description is provided of a seventh aspect of the technology of the present disclosure.

Based on any one of the first to sixth aspects, as illustrated in FIG. 14, the cam contact face (e.g., the cam contact face 131*d*S) includes a step (e.g., the step S). The step includes a step face (e.g., the step face M) having a curvature that is smaller than the increased curvature (e.g., the greatest curvature) of the cam face (e.g., the cam face 41*a*) of the cam (e.g., the cam 41) and is greater than the decreased curvature (e.g., the smallest curvature) of the cam face of the cam.

Accordingly, as described above with reference to FIG. 14, since the step is lowered by one step from a contact portion of the cam contact face, which contacts the cam face at the target contact position N1, the step separates from the cam face. Accordingly, the step prevents a portion of the cam face, which is not provided with the target contact position N1, from contacting the cam contact face more precisely.

A description is provided of an eighth aspect of the technology of the present disclosure.

Based on any one of the first to seventh aspects, as illustrated in FIG. 2, the cam contact face (e.g., the cam contact face 131*d*) is disposed at one end of the presser (e.g., the pressure lever 31). As the cam (e.g., the cam 41) presses the presser through the cam contact face, the presser pivots about a support shaft (e.g., the support shaft 33) serving as the fulcrum that supports another end (e.g., the supported end 31*a*) of the presser. The cam face (e.g., the cam face 41*a*) defines the distance from the center of rotation of the cam, which gradually increases in a rotation direction (e.g., the rotation direction G) of the cam. As illustrated in FIG. 16A, the support shaft serving as the fulcrum about which the presser pivots is disposed opposite the cam face oriented in a direction in which the distance from the center of rotation of the cam to the cam face gradually decreases from the contact position where the cam face contacts the cam contact face. For example, the cam further includes a distance decreasing portion (e.g., the distance decreasing portion 41*d*) in which the distance from the center of rotation of the cam to the cam face decreases gradually from the contact position where the cam face contacts the cam contact face. The support shaft is disposed opposite the distance decreasing portion of the cam.

Accordingly, as described above with reference to FIG. 16A, compared to a configuration depicted in FIG. 16B in which the support shaft serving as the fulcrum is disposed opposite a distance increasing portion (e.g., the distance increasing portion 41*i*) in which the distance from the center of rotation of the cam to the cam face increases gradually from the contact position where the cam face contacts the cam contact face, the cam face does not contact the cam contact face at a position different from the target contact position (e.g., the target contact position N1) on the cam face.

A description is provided of a ninth aspect of the technology of the present disclosure.

As illustrated in FIGS. 2, 19, and 20, a fixing device (e.g., the fixing devices 12, 80, and 90) includes a fixing rotator (e.g., the fixing roller 18, the fixing belt 83, and the opposed roller 92), a pressure rotator (e.g., the pressure rollers 19 and 84, and the fixing roller 91) that separably contacts the fixing rotator, and a contact-separation device (e.g., the contact-separation device 40), based on any one of the first to eighth aspects, which separably brings the pressure rotator into contact with the fixing rotator.

Accordingly, the fixing device improves accuracy in pressure applied to a fixing nip (e.g., the fixing nip N) formed between the fixing rotator and the pressure rotator, thus fixing an image on a recording medium (e.g., the sheet P) properly.

A description is provided of a tenth aspect of the technology of the present disclosure.

As illustrated in FIG. 1, an image forming apparatus (e.g., the image forming apparatus 1000) includes a contacted member (e.g., the fixing roller 18), a contact-separation member (e.g., the pressure roller 19) that separably contacts the contacted member, and a contact-separation device (e.g., the contact-separation device 40) that separably brings the contact-separation member into contact with the contacted member. The contact-separation device is configured based on any one of the first to eighth aspects.

Accordingly, the image forming apparatus moves the contact-separation member to a predetermined position precisely.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A contact-separation device for bringing a contact-separation member into contact with a contacted member separably, the contact-separation device comprising:

a biasing member configured to generate a biasing force;

a presser configured to press the contact-separation member against the contacted member in a pressing direction with the biasing force from the biasing member;

a cam configured to press the presser in an opposite direction being opposite to the pressing direction, the cam being rotatable and having a cam face; and a cam follower having a cam contact face configured to contact the cam face of the cam, the cam contact face being curved to project toward the cam, the cam contact face having a curvature that is smaller than a greatest curvature of the cam face of the cam and is greater than a smallest curvature of the cam face of the cam, wherein the cam follower is mounted on the presser.

2. The contact-separation device according to claim 1, wherein the cam follower is made of resin.

3. The contact-separation device according to claim 1, wherein the cam is configured to stop at a plurality of stop positions.

4. The contact-separation device according to claim 3, wherein the cam follower further has a presser contact face configured to contact the presser.

5. The contact-separation device according to claim 4, wherein, when seen in an axial direction of the cam, a hypothetical line passes through a center of rotation of the cam and a contact position where the cam face of the cam contacts the cam contact face of the cam follower.

6. The contact-separation device according to claim 5, wherein the plurality of stop positions of the cam includes a stop position where the cam presses the presser with an increased pressing amount; and the hypothetical line is perpendicular to the presser contact face of the cam follower when the cam stops at the stop position.

7. The contact-separation device according to claim 5, wherein the plurality of stop positions of the cam includes a stop position where the cam stops with an increased frequency; and the hypothetical line is perpendicular to the presser contact face of the cam follower when the cam stops at the stop position.

8. The contact-separation device according to claim 1, wherein the cam contact face of the cam follower includes a step having a step face, the step face having a curvature that is smaller than the greatest curvature of the cam face of the cam and is greater than the smallest curvature of the cam face of the cam.

9. The contact-separation device according to claim 1, further comprising:

a support shaft configured to support the presser at one end of the presser, the support shaft about which the presser pivots as the cam presses the presser, wherein the cam contact face of the cam follower is at another end of the presser.

10. The contact-separation device according to claim 9, wherein the cam face of the cam defines a distance from a center of rotation of the cam, the distance increasing gradually in a rotation direction of the cam.

11. The contact-separation device according to claim 10, wherein the cam includes a distance decreasing portion in which the distance from the center of rotation of the cam to the cam face decreases gradually from a contact position where the cam face contacts the cam contact face of the cam follower.

12. The contact-separation device according to claim 11, wherein the support shaft is opposite the distance decreasing portion of the cam.

13. The contact-separation device according to claim 1, wherein the biasing member includes a spring.

14. A fixing device comprising:

a fixing rotator;

a pressure rotator configured to contact the fixing rotator separably; and a contact-separation device configured to bring the pressure rotator into contact with the fixing rotator separably, the contact-separation device including:

a biasing member configured to generate a biasing force;

a presser configured to press the pressure rotator against the fixing rotator in a pressing direction with the biasing force from the biasing member;

a cam configured to press the presser in an opposite direction being opposite to the pressing direction, the cam being rotatable and having a cam face; and a cam follower having a cam contact face configured to contact the cam face of the cam, the cam contact face being curved to project toward the cam, the cam contact face having a curvature that is smaller than a greatest curvature of the cam face of the cam and is greater than a smallest curvature of the cam face of the cam, wherein the cam follower is mounted on the presser.

15. An image forming apparatus comprising:

a contacted member;

a contact-separation member configured to contact the contacted member separably; and a contact-separation device configured to bring the contact-separation member into contact with the contacted member separably, the contact-separation device including:

a biasing member configured to generate a biasing force;

a presser configured to press the contact-separation member against the contacted member in a pressing direction with the biasing force from the biasing member;

a cam configured to press the presser in an opposite direction being opposite to the pressing direction, the cam being rotatable and having a cam face; and a cam follower having a cam contact face configured to contact the cam face of the cam, the cam contact face being curved to project toward the cam, the cam contact face having a curvature that is smaller than a greatest curvature of the cam face of the cam and is greater than a smallest curvature of the cam face of the cam, wherein the cam follower is mounted on the presser.

16. The image forming apparatus according to claim 15, wherein the contacted member includes one of a roller and a belt; and the contact-separation member includes a roller.

17. The image forming apparatus according to claim 15, wherein the cam follower is made of resin.

18. The image forming apparatus according to claim 15, wherein the cam is configured to stop at a plurality of stop positions.

19. The image forming apparatus according to claim 18, wherein the cam follower further has a presser contact face configured to contact the presser.

* * * * *